US009565933B2

(12) United States Patent
Kasza et al.

(10) Patent No.: US 9,565,933 B2
(45) Date of Patent: Feb. 14, 2017

(54) BOTTLE RACK AND KIT FOR BOTTLE-SUPPORTING ASSEMBLY

(71) Applicant: STACT Wine Displays Inc., Vancouver (CA)

(72) Inventors: Jamie Dennis Kasza, Vancouver (CA); Eric John Pfeiffer, Oakland, CA (US)

(73) Assignee: STACT WINE DISPLAYS INC., Vancouver, British Columbia (CA)

( * ) Notice: Subject to any disclaimer, the term of this patent is extended or adjusted under 35 U.S.C. 154(b) by 0 days.

(21) Appl. No.: 14/837,563

(22) Filed: Aug. 27, 2015

(65) Prior Publication Data

US 2015/0366341 A1 Dec. 24, 2015

Related U.S. Application Data

(63) Continuation of application No. 13/658,568, filed on Oct. 23, 2012, now Pat. No. 9,149,115.

(Continued)

(51) Int. Cl.
*A47F 5/00* (2006.01)
*A47B 73/00* (2006.01)

(Continued)

(52) U.S. Cl.
CPC ..... *A47B 73/006* (2013.01); *A47B 73/00* (2013.01); *A47F 5/0815* (2013.01);

(Continued)

(58) Field of Classification Search
CPC ..... A47B 73/006; A47B 73/00; A47B 73/002; A47B 73/004; A47B 73/008; A47B 96/067; A47B 95/008; A47B 57/42; A47B 57/52; A47B 47/022; A47B 61/02; A47F 7/28; A47F 5/0846; A47F 7/281; A47F 7/285; A47F 5/0843; A47F 5/08;A47F 5/0807; A47F 5/0815; A47F 5/0823; A47F 5/083; A47F 5/0838; A47F 5/0869; A47F 7/021; A47F 7/0243; A47F 5/00; A47J 47/16; A47G 25/0685; A47K 10/04

(Continued)

(56) References Cited

U.S. PATENT DOCUMENTS 583,727 A * 6/1897 Braun ..... A47B 73/00 211/74
698,272 A 4/1902 Glover (Continued)

FOREIGN PATENT DOCUMENTS

CA 1 012 095 6/1977
CA 2 456 638 2/2004

(Continued)

OTHER PUBLICATIONS

Amazon.fr, Product Description, Blomus Pilare /68486 Casier a vin Pour 12 Bouteilles [Blomus Pilare /68486 Wine Rack for 12 Bottles], http://www.amazon.fr/blomus-pilare-68486-Casier-bouteilles/dp/B000BKBJWC/ref=sr_1_1?ie=UTF8&qid=1421968472&sr=8-1&keywords=Blomus+Pilare, date first available at Amazon.fr Aug. 8, 2007 (accessed Jan. 22, 2015).

(Continued)

*Primary Examiner* — Jennifer E Novosad
(74) *Attorney, Agent, or Firm* — LeClairRyan, a Professional Corporation

(57) ABSTRACT

A bottle rack includes a bottle-supporting assembly having an elongate portion and support bars connected to the elongate portion, with the support bars being spaced longitudinally along the elongate portion and suitable to support bottles therebetween; and a panel having support bar apertures suitable for the support bars of the bottle-supporting assembly to extend through. The bottle-supporting assembly (Continued)

is secured onto the panel with the support bars extending through the apertures of the panel. The bottle supporting assembly may be supplied in the form of a kit.

32 Claims, 24 Drawing Sheets

Related U.S. Application Data

(60) Provisional application No. 61/660,714, filed on Jun. 16, 2012.

(51) Int. Cl.

| | |
|---|---|
| ***A47F 5/08*** | (2006.01) |
| *A47B 57/42* | (2006.01) |
| *A47B 57/52* | (2006.01) |
| *A47B 47/02* | (2006.01) |
| *A47F 7/28* | (2006.01) |

(52) U.S. Cl.
CPC ..... *A47F 5/0823* (2013.01); *A47B 47/022* (2013.01); *A47B 57/42* (2013.01); *A47B 57/52* (2013.01); *A47F 5/0846* (2013.01); *A47F 7/28* (2013.01)

(58) Field of Classification Search
USPC ..... 211/75, 94.01, 87.01, 74, 193, 59.1, 85.1,211/106.01, 99, 100, 85.9, 86.01, 57.1, 7; D7/701; 248/220.31, 223.41, 224.7, 224.8, 248/225.11, 220.22, 220.21
See application file for complete search history.

(56) References Cited

U.S. PATENT DOCUMENTS 1,835,726 A 12/1931 Thompson
2,026,746 A 1/1936 Moore
2,051,408 A 8/1936 Karst
2,070,507 A 2/1937 Bishop
2,100,421 A 11/1937 Wupper
2,527,796 A 10/1950 Clute
2,879,900 A 3/1959 Fox
2,889,050 A * 6/1959 Modrey ..... A47G 29/10 211/4
3,181,701 A * 5/1965 Cole ..... B08B 9/423 211/74
3,200,960 A 8/1965 Banse
3,204,867 A * 9/1965 Wahlbom ..... A47B 73/008 211/74
3,255,987 A * 6/1966 Gatch ..... F16B 21/02 108/156
3,799,357 A * 3/1974 Govang ..... A47F 5/0815 206/459.5
D232,284 S 8/1974 Shuck
3,836,007 A 9/1974 Rosenwein
D236,565 S 9/1975 Fuller
3,924,750 A 12/1975 Dunchock
3,938,667 A 2/1976 Buckland
4,022,327 A 5/1977 Anderson
D260,463 S 9/1981 Imus
D262,334 S 12/1981 Clarke, Jr. et al.
4,319,730 A 3/1982 Thalenfeld
4,482,065 A * 11/1984 Altemose ..... A47B 73/00 211/74
4,485,929 A 12/1984 Betts, Sr.
D284,720 S * 7/1986 Watson ..... D7/701
D295,128 S 4/1988 Gentile
4,805,783 A 2/1989 Mayer
4,944,415 A 7/1990 Orbach
5,025,936 A 6/1991 Lamoureaux
5,116,007 A * 5/1992 Von Gunton et al. . A47B 57/42 108/108
5,163,567 A 11/1992 Betts, Sr.
5,169,009 A * 12/1992 Bomze ..... A47B 73/00 211/187
5,499,724 A * 3/1996 Hickman ..... B25H 3/04 211/59.1
5,503,276 A 4/1996 Pierce
5,678,794 A * 10/1997 Kump ..... A47F 5/0869 211/59.1
5,711,436 A 1/1998 Moeller et al.
5,727,698 A 3/1998 Lai
5,785,187 A * 7/1998 Lipman et al. ..... A47F 5/0815 211/54.1
5,813,550 A 9/1998 Sheehan et al.
5,855,347 A * 1/1999 Hollingsworth ..... A47F 5/0823 211/59.1
6,119,875 A 9/2000 Smith
6,161,707 A * 12/2000 Lin ..... A47G 25/06 211/32
6,173,845 B1 * 1/2001 Higgins ..... A47F 7/28 211/181.1
6,361,129 B1 * 3/2002 Borgen ..... A47F 7/28 211/74
D460,902 S 7/2002 Battle
6,443,316 B1 * 9/2002 Mao ..... A47F 5/0807 211/41.3
6,561,474 B1 * 5/2003 Walter ..... A47F 5/0853 211/94.01
6,575,312 B2 * 6/2003 Santa Cruz ..... A47F 7/0028 211/70.6
6,644,483 B1 * 11/2003 Lai ..... A47F 5/0823 211/57.1
6,675,978 B2 * 1/2004 Shea ..... A47F 5/0823 211/181.1
6,695,154 B2 2/2004 Jacobs
6,729,481 B1 * 5/2004 O'Brien ..... A47B 73/00 211/74
6,763,956 B2 * 7/2004 Woods ..... A47B 73/00 211/74
D497,526 S 10/2004 Sanders et al.
6,808,147 B2 * 10/2004 Brannen ..... A47J 47/20 248/213.2
D509,108 S * 9/2005 Rosenberg ..... D7/601
6,991,117 B2 1/2006 McCain
7,284,671 B1 * 10/2007 Doscher ..... A63B 71/0036 211/106.01
7,284,734 B2 10/2007 Hamerski
7,377,397 B2 5/2008 Lee et al.
7,392,912 B2 7/2008 Zandt
7,673,761 B2 3/2010 Lee et al.
7,806,268 B2 * 10/2010 Angelocci ..... B65D 73/0064 206/495
7,850,017 B2 12/2010 McCain
7,861,986 B2 * 1/2011 Cline ..... E04B 2/7416 211/94.01
7,882,967 B2 2/2011 Hynes
D634,992 S 3/2011 McNamee
D655,986 S 3/2012 Schneider
8,231,015 B2 7/2012 McCain
D678,011 S * 3/2013 Wylie ..... D7/704
8,573,548 B2 11/2013 Kuhn et al.
8,607,994 B1 * 12/2013 Schneider ..... A47B 73/00 211/106
D708,494 S * 7/2014 Carpenter ..... D7/701
D739,190 S * 9/2015 Kasza ..... D7/701
9,149,115 B2 * 10/2015 Kasza ..... A47B 73/006
2001/0013567 A1 8/2001 Valiulis
2003/0057336 A1 3/2003 Hochman
2004/0069730 A1 4/2004 Woods
2004/0144740 A1 7/2004 Przygoda
2005/0072746 A1 4/2005 O'Brien
2007/0039907 A1 2/2007 Zandt
2007/0068887 A1 3/2007 Nawrocki
2008/0000861 A1 1/2008 Muellerleile
2009/0071920 A1 3/2009 Bassetti
2010/0006523 A1 1/2010 Hogeback
2010/0051769 A1 3/2010 Tyson
2011/0132853 A1 6/2011 Drobot et al.

(56) References Cited

U.S. PATENT DOCUMENTS

| | | | |
|---|---|---|---|
| 2011/0309220 | A1 | 12/2011 | Collini |
| 2012/0085721 | A1 | 4/2012 | Michael J. et al. |
| 2013/0334155 | A1 | 12/2013 | Kasza et al. |

FOREIGN PATENT DOCUMENTS

| | | | |
|---|---|---|---|
| CA | 2 677 021 | | 2/2010 |
| CA | 2 743 948 | | 5/2010 |
| DE | 3015594 | A1 | 12/1981 |
| DE | 20309209 | U1 | 8/2003 |
| EP | 1 389 437 | | 2/2004 |
| FR | 065229-0001 | | 1/2007 |
| GB | 1 202 519 | | 8/1970 |
| GB | 2 189 387 | A | 10/1987 |
| GB | 2 242 352 | A | 10/1991 |
| NL | 1021103 | C1 | 1/2004 |
| WO | 20141032158 | A1 | 3/2014 |

OTHER PUBLICATIONS

Hayneedle.com, Product Description, Blomus Pilare Wine Rack—Choose 9 or 12 Bottle Rack, review 1 dated Nov. 9, 2006, http://www.hayneedle.com/product/pilarewinerack.cfm (accessed Jan. 10, 2015).

Amazon.com, Product Description, Blomus Wine Bottle Storage, Holds 12 Bottles, review by Brian Go dated Aug. 2, 2011, http://www.amazon.com/Blomus-Bottle-Storage-Holds-Bottles/dp/B000BKBJWC (accessed Jan. 10, 2015).

Walmart.com, Product Description, Blomus Pilare Wine Rack—Choose 9 or 12 Bottle Rack, review by Carol-Simplify dated Mar. 26, 2008, http://www.walmart.com/ip/blomus-Pilare-Wine-Rack-Choose-9-or-12-Bottle-Rack/17361365, (accessed Jan. 10, 2015).

Amazon.de, Product Description, Blomus 68486 PILARE Weinregal, für 12 Flaschen [Blomus 68486 PILARE Wine Rack for 12 Bottles], http://www.amazon.de/Blomus-68486-PILARE-Weinregal-Flaschen/dp/B000BKBJWC, date first available at Amazon.de Sep. 22, 2005 (accessed Jan. 22, 2015).

Stact.com, "Turn Your Wine Into Art," http://www.getstact.com/ (archived Jul. 29, 2012).

Rosendahl, Spec Sheet, Wine Rack, https://web.archive.org/web/20050304022515/http://www.unicahome.com/products/pdf/9223/rosendahl_wine_rack.pdf (Feb. 8, 2005).

International Search Report for PCT/CA2013/000259, published as WO 20141032158 (Dec. 23, 2013).

Vin De Garde Cellar Systems, Modern Wine Cellars Catalog 2011 (2011).

Genuwine Cellars, Label Link (retrieved from http://www.genuwinecellars.com/metal-series/label-link/on Jan. 25, 2013).

Genuwine Cellars, PEG System (retrieved from http://www.genuwinecellars.com/metal-series/peg-system/ on Jan. 25, 2013).

Genuwine Cellars, Metal Series (retrieved from http://www.genuwinecellars.com/metal-series/on Feb. 21, 2013).

Houzz Inc., Bachus Bottle Rack—modern—wine racks—by Made in Design, 2013 (retrieved from http://www.houzz.com/photos/151858/Bachus-Bottle-Rack-modern-wine-racks—on Jul. 18, 2013).

Houzz Inc., Live-Edge Solid Walnut 6-Bottle Wine Rack—eclectic—wine racks—by Etsy, 2013 (retrieved from http://www.houzz.com/photos/2739502/Live-Edge-Solid-Walnut-6-Bottle-Wine-Rack-eclectic-wine-rack—on Jul. 18, 2013)

Houzz Inc., Wood & Metal Industrial Wine Rack—contemporary—wine racks—by World Market, 2013 (retrieved from http://www.houzz. com/photos/1548374/Wood---Metal-Industrial-Wine-Rack-contemporary-wine-racks—on Jul. 18, 2013).

STACT Wine Displays Inc., STACT revolutionary wine rack, 2013 (retrieved from http://www.getstact.com/collections/wine-rack-revolutionized on Jul. 18, 2013).

Kickstarter.com, "STACT Modular Wine Wall: Wine Storage Beautified," launched Jul. 26, 2012, http://www.kickstarter.com/projects/stact/stact-modular-wine-wall-wine-storage-beautified (archived Jul. 28, 2012)

Marketwired.com, "Wine Storage Beautified: Canada's STACT Modular Wine Wall System Launches Globally through Kickstarter," http://www.marketwired.com/press-release/wine-storage-beautified-canadas-stact-modular-wine-wall-system-launches-globally-through-1684078.htm (Jul. 26, 2012).

Gillian Shaw, "Vancouver Wine Connoisseur Launches Successful Kickstarter Project to Fund the Perfect Wine Rack," Vancouver Sun, Digital Life, http://blogs.vancouversun.com/2012/07/28/vancouver-wine-connoisseur-launches-successful-kickstarter-project-to-fund-the-perfect-wine-rack/ (Jul. 28, 2012).

Kim Hart Macneill, "A New Way to Kickstart a Business," Profitguide.com, http://www.profitguide.com/startup/best-practices/mass-appeals-40210 (Sep. 5, 2012).

Uncrate.com, "Stact Modular Wine Wall," http://uncrate.com/stuff/stact-modular-wine-wall/ (archived Jul. 30, 2012).

billwang.net, Design Online, [Billwang Industrial Design Forum > Industrial Design Zone > Design Resources > Design Resources Digest > Nordic windows, some household items map , p. 25 Update (Jul. 5 )], Posted on Dec. 11, 2006 , 17:04, http://bbs.billwang.net/post5298125-187/ (accessed Jan. 22, 2015).

Extended European Search Report for European Patent Application No. 13172148.2 (Aug. 19, 2013).

Vin De Garde, "Beta Bloc—Single Bottle," 3D Warehouse SketchUp, http://sketchup.google.com/3dwarehouse/details?mid=950db41b6d3bdOedc72a6080at74e2bc, 1 page (Nov. 30, 2012).

Billy Carpenter, Twitter Post, https://twitter.com/moderncellars/status/252140684579061760, 1 page (Sep. 29, 2012).

Billy Carpenter, Twitter Post, https://twittercom/moderncellars/status/254266152501526529, 1 page (Oct. 5, 2012).

Vin De Garde, 2013 Catalog, "Vin De Garde 2013, Modern Wine Cellars," pp. 1-29 (2013).

* cited by examiner

BOTTLE RACK AND KIT FOR BOTTLE-SUPPORTING ASSEMBLY

This application is a continuation of U.S. patent application Ser. No. 13/658,568, filed Oct. 23, 2012, which claims the benefit of U.S. Provisional Patent Application Ser. No. 61/660,714, filed Jun. 16, 2012, each of which is hereby incorporated by reference in its entirety.

FIELD OF THE INVENTION

The present disclosure relates to a bottle rack and to a kit for a bottle-supporting assembly that may be used in assembling the bottle rack.

BACKGROUND OF THE INVENTION

Bottle racks, such as those used to store and display bottles of wine, serve both aesthetic and functional purposes. A designer designing a bottle rack takes into account various considerations when designing the rack; for example, the designer considers how to design the rack so that it is relatively easy to manufacture, transport, and assemble; so that is structurally sound; and so that it uses space efficiently. Designs for bottle racks continue to evolve with a view to creating a design that is superior in one or more ways to conventional designs for bottle racks.

SUMMARY OF THE INVENTION

According to an aspect, there is provided a bottle rack comprising: a bottle-supporting assembly having an elongate portion and a plurality of support bars connected to the elongate portion, wherein the support bars are spaced longitudinally along the elongate portion and suitable to support bottles therebetween; and a panel having a plurality of support bar apertures suitable for the support bars of the bottle-supporting assembly to extend through, wherein the bottle-supporting assembly is secured onto the panel with the support bars extending through the apertures of the panel.

In some embodiments, the elongate portion has a first side facing the panel, and the support bars are aligned in a row along the elongate portion and are substantially perpendicular to the first side of the elongate portion. Further, each of the support bars has a first end; the elongate portion can have a groove on the first side shaped to snugly receive the first end of said support bar; and the support bar can be fastened to the elongate portion by a first fastener with its first end inserted in the groove of the elongate portion.

Each of the support bars can have a top side and a bottom side parallel to the top side. The groove of the elongate portion has two parallel edges extending longitudinally along the elongate portion. The groove of the elongate portion is shaped to snugly receive the first end of the support bar with the top and bottom sides fitting into the two edges of the groove.

Alternatively, the elongate portion can have a plurality of apertures shaped to snugly receive the first ends of the support bars; each of the support bars is inserted in one of the second apertures of the elongate portion. Each of the support bars can be welded to the elongate portion at the first end, or fastened to the elongate portion by a support bar fastener at the first end. The support bar fastener can comprise at least one screw.

Alternatively, the elongate portion and the support bars can also be integral.

Alternatively, the elongate portion can have a plurality of bar slots on its first side, spaced longitudinally along the elongate portion without extending through the elongate portion, each of the bar slots is shaped to snugly receive the first end of the support bar; the support bar is fastened to the elongate portion by a first fastener with its first end inserted in one of the bar slots.

The elongate portion can have a plurality of assembling apertures suitable for a plurality of assembling fasteners to fasten the elongate portion to the panel. In an embodiment, the elongate portion has two parallel edges extending along its longitudinal direction; and the plurality of assembling apertures are positioned along the two edges so that every other one of the assembling apertures along the elongate portion is on the same side of the elongate portion.

The bottle rack can further comprise a pair of mounting brackets affixed to the panel for mounting the panel to a wall. In an embodiment, each of said mounting brackets can have at least one keyhole-shaped aperture; and the panel has at least one pair of protrusions suitable to insert within the keyhole-shaped apertures thereby selectively connecting the panel to the brackets.

The bottle rack can comprise a plurality of said panels each having at least one said bottle-supporting assembly. In an embodiment, the bottle rack comprises at least one link mechanism suitable to link two mounting brackets that mount two adjacent panels. Each of the two mounting brackets can comprise a wall-abutting portion to abut the wall when the bottle rack is mounted to the wall; a peripheral portion connected to and extending outwards from the wall-abutting portion; and a panel-abutting portion connected to and extending from the peripheral portion, to which the panel is affixed. Each of the mounting brackets can have a channel between the wall-abutting portion and the panel-abutting portion at least one end of the mounting bracket; in embodiments in which the mounting brackets are extruded, the channel may extend between the ends of each of the mounting brackets and have a uniform cross-section. The link mechanism can comprise a link plate suitable to insert into the channels of the mounting brackets and at least two link fasteners for securing the link plate in the channel of the mounting brackets respectively. Each of the link fasteners can comprise a link screw having a socket in its head. The link plate can comprise at least two threaded apertures suitable to receive the screws. The link mechanism can be configured in a manner that when each of the link screw is screwed in and forced against the panel-abutting portion of the mounting bracket, the link plate is pressed against the wall-abutting portion of the mounting bracket, thereby securing the link mechanism in the channel of the mounting bracket.

Alternatively, at least one of the mounting brackets can have a greater length than the panels, and thus at least two adjacent panels can be connected to said mounting bracket.

In different embodiments, the elongate portion can extend either vertically or horizontally after the bottle rack is assembled.

According to another aspect, there is provided a kit for a bottle-supporting assembly for use in a bottle rack. The bottle-supporting assembly comprises an elongate portion having fastener apertures spaced longitudinally therealong; and a plurality of support bars connectable to the elongate portion using fasteners inserted through said fastener apertures. Each of the fastener apertures has a cross-sectional profile that prevents the support bar connected via said fastener aperture from being inserted through said fastener aperture.

The bottle-supporting assembly can further comprise a plurality of support bar fasteners insertable through the fastener apertures to secure the plurality of support bars to the elongate portion. The support bar fasteners can comprise screws.

In some embodiments, the elongate portion has a first side, and each of the support bars is connectable to the first side of the elongate portion. The elongate portion has a first side. Each of the support bars has a first end. The elongate portion can have a groove on the first side shaped to snugly receive the first end of said support bar. Each of the fasteners is suitable to fasten the support bar to the elongate portion with the first end inserted in the groove of the elongate portion.

Each of the support bars can have a top side and a bottom side parallel to the top side. The groove of the elongate portion can have two parallel edges extending longitudinally along the elongate portion. The groove of the elongate portion can be shaped to snugly receive the first end of the support bar with the top and bottom sides fitting into the two edges of the groove.

Alternatively, the elongate portion can have a plurality of second apertures extending through the first side and shaped to snugly receive the first ends of the support bars.

Alternatively, the elongate portion and the support bars can also be integral.

In another embodiment, the elongate portion has a plurality of bar slots on its first side, spaced longitudinally along the elongate portion without extending through the elongate portion, each of the bar slots is shaped to snugly receive the first end of the support bar.

The elongate portion can further comprises a plurality of assembling apertures suitable for a plurality of assembling fasteners to fasten the elongate portion to a panel or a wall. In an embodiment, the elongate portion has two parallel edges extending along its longitudinal direction. The assembling apertures are positioned along the two edges so that every other one of the assembling apertures along the elongate portion is on the same side of the elongate portion.

According to another aspect, there is provided a modular, wall-mountable wine rack comprising: a bottle-supporting member having an elongate portion and a plurality of spaced-apart support bars connected to and aligned in a row along the elongate portion, the support bars being cantilevered from the elongate portion and being positioned to support wine bottles therebetween.

The elongate portion and the support bars can be integral. Alternatively, the wine rack can further include a fastener for connecting the elongate portion of the bottle-supporting member to a wall.

The wine rack can also comprise a pair of spaced-apart brackets for mounting to a wall; and a panel having a row of spaced-apart apertures, the support bars extending through the apertures and the panel connecting to, extending between and being supported by the brackets.

Each said bracket can have a keyhole-shaped aperture and wherein the panel has a pair of spaced-apart, peripherally positioned protrusions insertable within the keyhole-shaped apertures for selectively connecting the panel to the brackets.

The support bars can be in cross-section rectangular with semicircular ends.

According to another aspect, there is provided a modular wine rack comprising: one or more panels, the one or more panels each having a rear positioned to face a wall and a front opposite the rear; a pair of spaced-apart brackets arranged vertically on and fixed to the wall, each of the one or more panels being supported parallel to the wall vertically by the brackets; and two or more bottle-supporting members, each bottle-supporting member having an elongate plate and at least three spaced-apart, extruded support bars, each of the support bars having a base, the support bars being fastened together at their bases to the plate, the support bars being in cross-section rectangular with semicircular ends, the bottle-supporting members being fixed to the rear of one of the one or more panels such that the support bars protrude through like-shaped apertures of said one of the one or more panels and extend past the front of the one of the one or more panels, the support bars so configured being in a cantilevered position and having a length, width, and integrity sufficient to support conventional-sized wine bottles therebetween.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more exemplary embodiments:

FIGS. 25A and 25B are top plan views of a bottle-supporting assembly that can be used in the wine rack according to a ninth embodiment, wherein FIG. 25B is an enlarged view of part of FIG. 25A; and FIGS. 26A and 26B are top plan views of a bottle-supporting assembly that can be used in the wine rack according to a tenth embodiment, wherein FIG. 26B is an enlarged view of part of FIG. 26A.

DETAILED DESCRIPTION OF THE INVENTION

Directional terms such as "top", "bottom", "left" and "right" are used in the following description for the purposes of providing relative reference only, and are not intended to suggest any limitations on how any apparatus or components thereof are to be manufactured or positioned during use. A number of preferred embodiments will now be described by way of example only.

Figure 1:
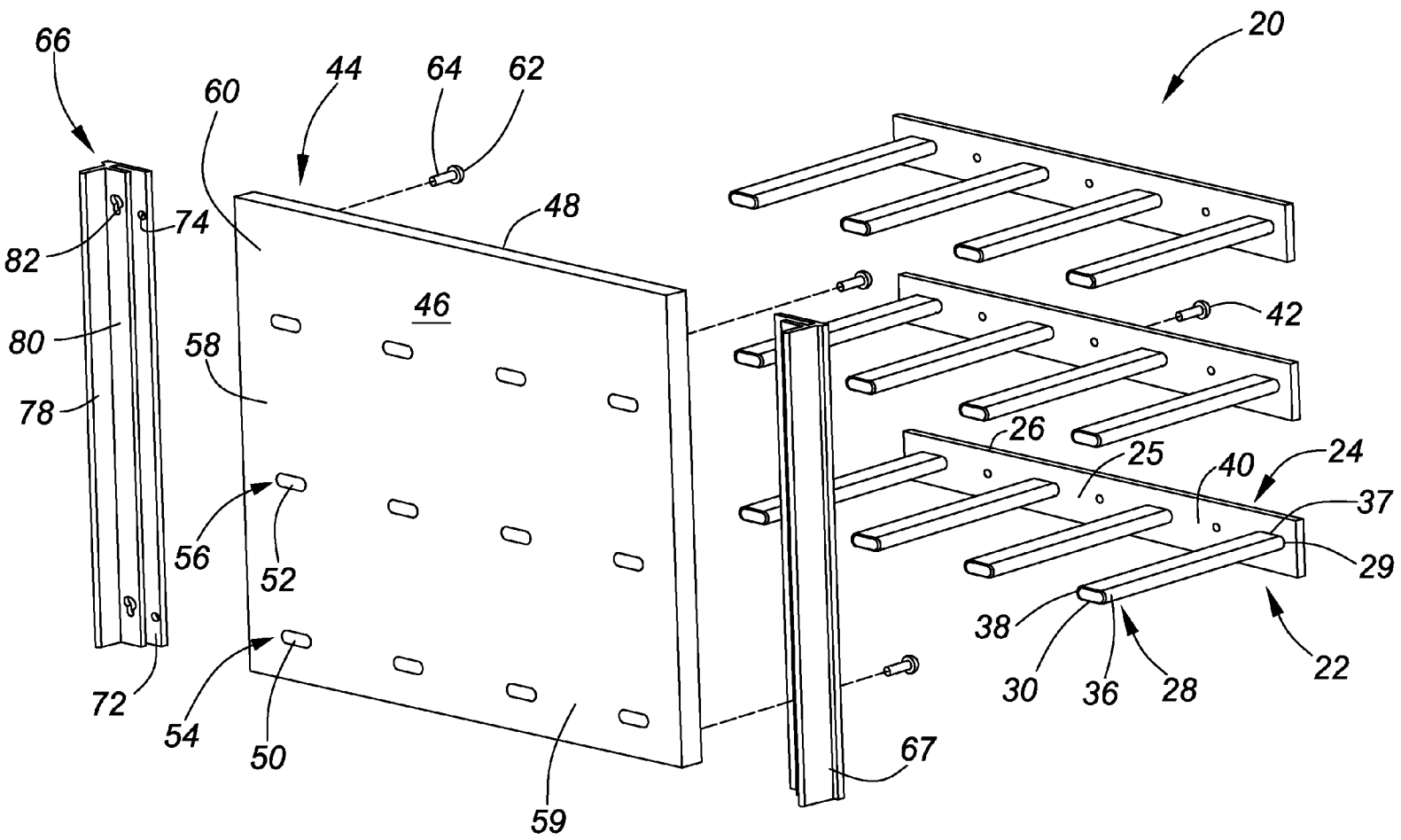
FIG. 1 is an exploded, perspective view of a modular, wall-mountable bottle rack according to a first embodiment.

Referring to the drawings and first to FIG. 1, there is shown a modular, wall-mountable bottle rack 20. The bottle rack 20 in this embodiment can be used as a wine rack, and when used as a wine rack may interchangeably be referred to as a wine rack or a wine rack assembly. The bottle rack 20 includes a plurality of bottle-supporting members, in this example three members, as shown by member 22. Each bottle-supporting member has an elongate portion, in this example an elongate plate 24. The plate is rectangular in this example, has a front 25 and a rear 26 opposite thereof as seen in FIG. 3, which is configured to face a wall 27, shown in FIG. 2. Each bottle-supporting member has a plurality of spaced-apart support bars, in this example four bars, as shown by bar 28 in FIG. 1, aligned in a row. The support bars are cantilevered from the plates 24. Each support bar 28 has a base or proximal end 29 connected to the front 25 of its plate 24 and a distal end 30 spaced-apart from the proximal end 29.

Figure 2:
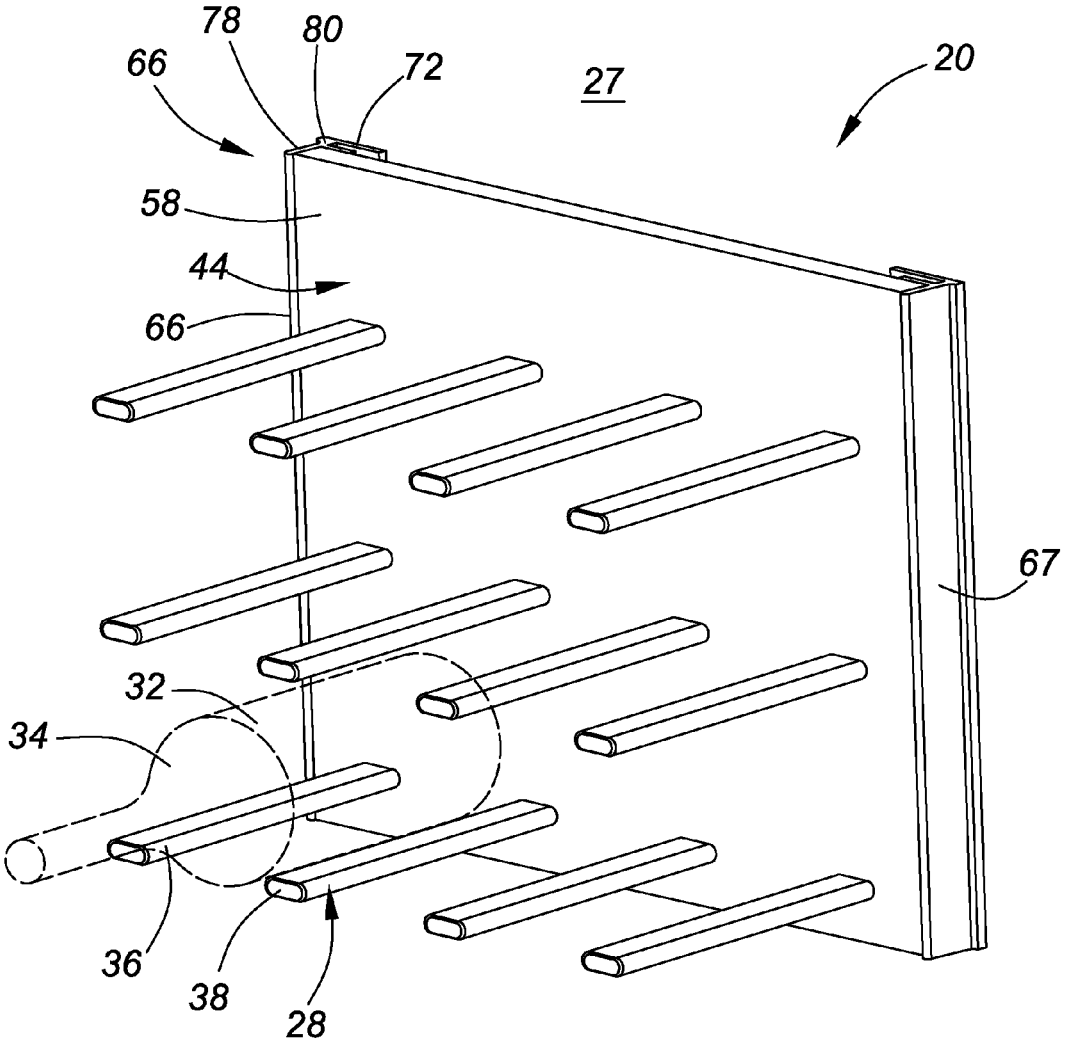
FIG. 2 is an assembly, perspective view of the bottle rack of FIG. 1.
Figure 3:
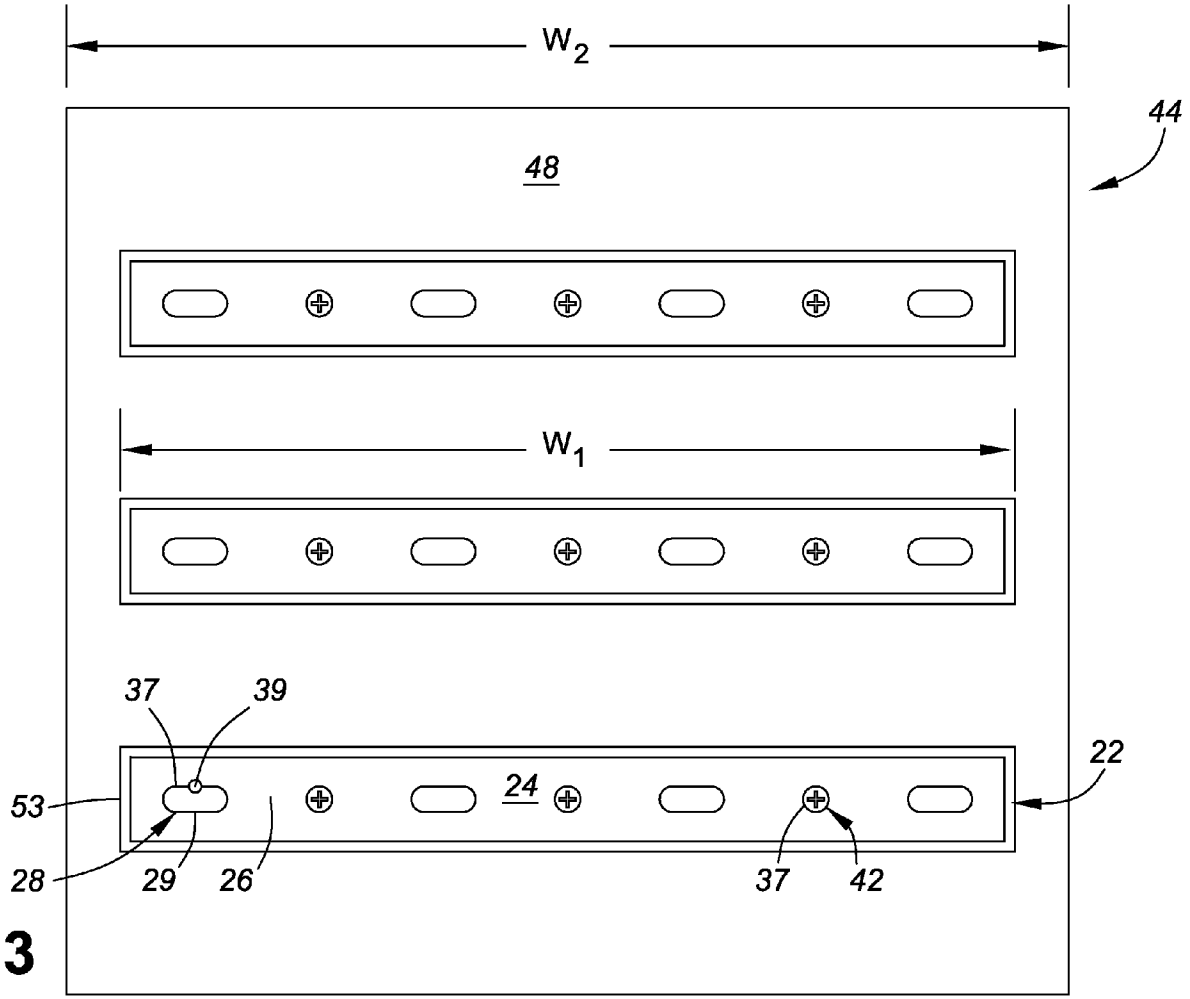
FIG. 3 is a rear elevation view of a panel of the assembly of FIG. 1, with a plurality of bottle-supporting members connected thereto.

The support bars 28 are positioned to support wine bottles, as shown by bottle 34 in FIG. 2, therebetween. The support bars 28 in this example each have a cross-section in the shape of a rectangle having a pair of semicircular ends. The support bars 28 are shaped to substantially abut and extend along the length of the lower portion 32 of the wine bottle, as seen in FIG. 2. Each support bar has a pair of spaced-apart, peripheral rounded edges 36 and 38 in this example, upon which the bottles rest.

Referring to FIG. 3, each plate 24 has a first plurality of spaced-apart apertures, in this example four apertures as shown by aperture 37. Each aperture 37 is in the shape of a rectangle having a pair of semicircular ends. The apertures 37 are positioned to align with respective ones of the bars 28 shown in FIG. 1. The apertures 37 are configured to be slightly larger than the bars. This enables bars 28 to be disposed within the apertures 37. The bars 28 may then be spot welded, as shown by weld 39 in FIG. 3, from the rear 48 of the panel 44. Thus, the support bars are welded at their ends 29 to their respective plates 24, and plates 24 and the support bars 28 are thus integral and form a single part in this embodiment.

Referring to FIG. 1, each plate 24 of bottle-supporting member 22 includes a second plurality of spaced-apart apertures, in this example three apertures as shown by aperture 40, extending through its plate 24. The apertures are interposed between respective ones of the supporting rods 28 and apertures 37. The bottle rack 20 includes a plurality of fasteners, in this example screws as shown by screw 42, selected to extend through the apertures 40 via the rear 26 of the plates 24. This is shown in FIG. 3.

Figure 9:
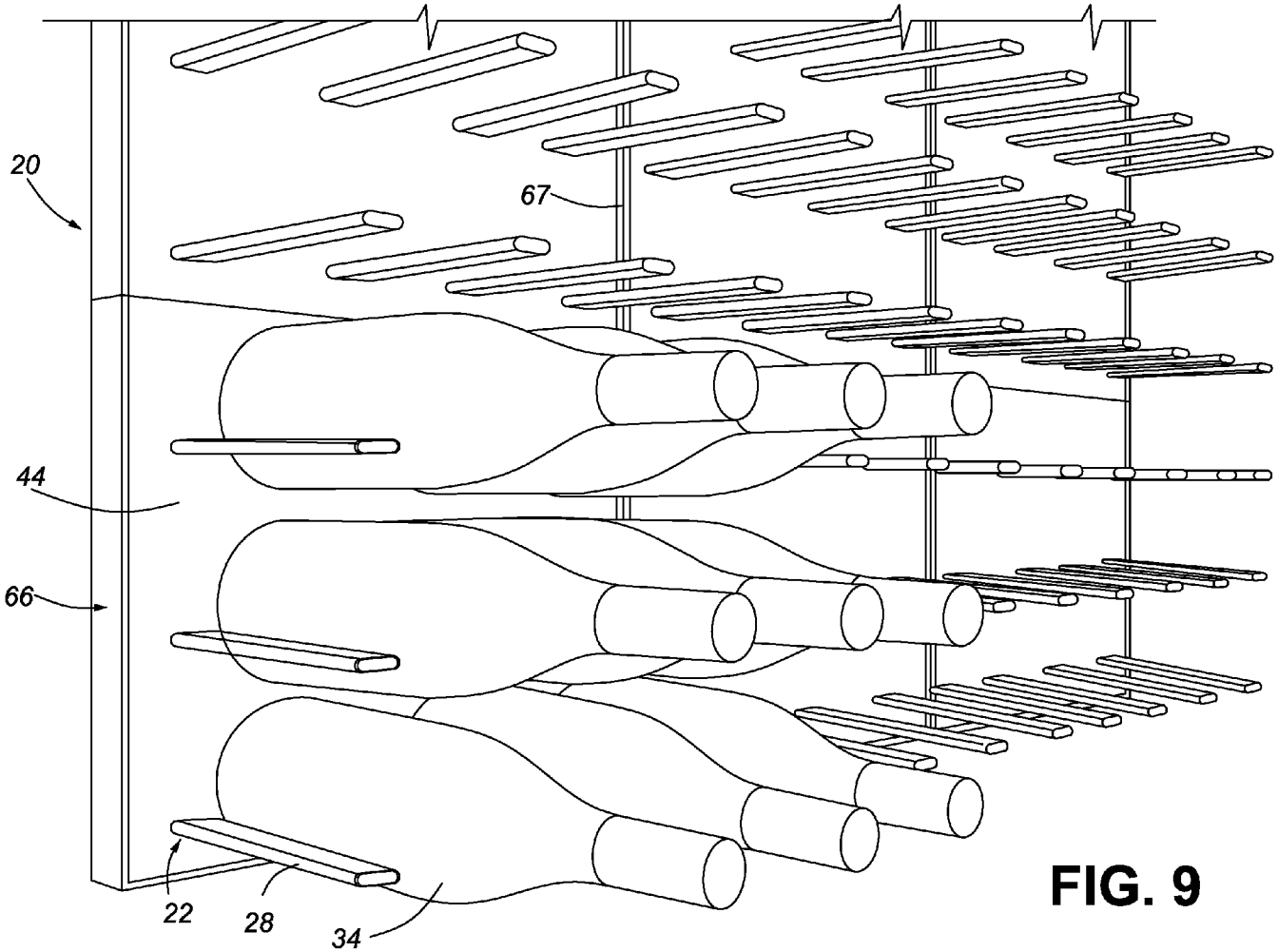
FIG. 9 is a front perspective view of the modular, wall-mountable bottle rack of FIG. 1 showing a plurality of panels and brackets.

As seen in FIG. 9, the bottle rack 20 may be modular and thus include a plurality of bottle-supporting members 22, brackets 66 and 67, and respective modular panels therefor, as shown by way of example by the single panel 44. Each panel is rectangular and flat in this example. Referring to FIG. 1, each panel 44 may be made of high quality materials, such as wood veneer, for example, offering a modern aesthetic appeal that may previously only have been found in custom made high-end modern wine cellars, avant-garde restaurants and wine bars. Each panel 44 has a front 46 and a rear 48 opposite thereof, the rear being configured to face wall 27 shown in FIG. 2. Each panel has a plurality of rows of spaced-apart apertures, in this example in the form of three rows of apertures, as shown by apertures 50 and 52 for rows 54 and 56. The apertures are generally rectangular in this example with rounded ends and are arranged in a grid-like series of rows and columns in this example. The apertures 50 and 52 are shaped to receive the support bars 28, thus enabling ends 30 of the support bars to pass therethrough such that the fronts 25 of the plates 24 abut the rear 48 of panel 44.

Each panel 44 has a series of vertically spaced-apart rectangular recessed portions, in this example three recessed portions as shown by recessed portion 53 in FIG. 3. The recessed portions extend inwards from the rear 48 of the panel. Recessed portions 53 are shaped to snugly receive the plates 24 of respective ones of the bottle-supporting members 22. The spacing between the recessed portions 53 and plates 24 is shown in an exaggerated matter for illustrative purposes. The bottle-supporting members 22 are thus counter sunk into the rear 48 of panel 44. As seen in FIG. 3, each of the plates 24 has a width W1 that is equal to less than the overall width W2 of the panel 44 in this example. Upon the plates 24 being so positioned within recessed portions 53 with the support bars 28 extending through the apertures 50 and 52 of the panel, screws 42 may connect the plates 24 of the bottle-supporting members 22 to the rear 48 of panel 44, in this example. Referring back to FIG. 1, each panel 44 has a pair of spaced-apart peripheral side edge portions 58 and 59 and four spaced-apart corners aligning with respective ones of the edge portions, as shown by corner 60.

Figure 4:
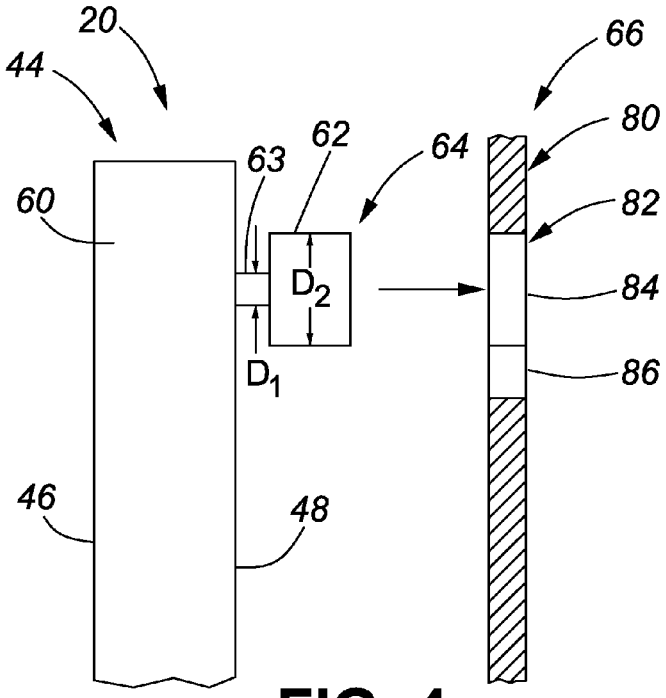
FIG. 4 is a fragmentary, side elevation view of the panel of FIG. 3, the panel having a fastener head protruding outwards therefrom, and a sectional view of a part of a bracket of the assembly of FIG. 1, the assembly having a keyhole-shaped aperture.

The bottle rack 20 has a plurality of protrusions, in this example in the form of fastener heads 62 of fasteners, in this example screws 64. Referring to FIG. 4, each screw has a shaft 63 with a cross-sectional diameter D1 which is smaller than the cross-sectional diameter D2 of the fastener head. The screws 64 connect to the rear 48 of the panel 44 along the peripheral edge portions 58 and 59 seen in FIG. 1. In this example, the screws 62 connect to portions adjacent to the respective corners 60 of the panel 44. There are thus four screws in this example, one for each corner of the panel. Fastener heads 62 extend outwards from the rear 48 of the panel 44, as seen in FIG. 4.

Figure 8:
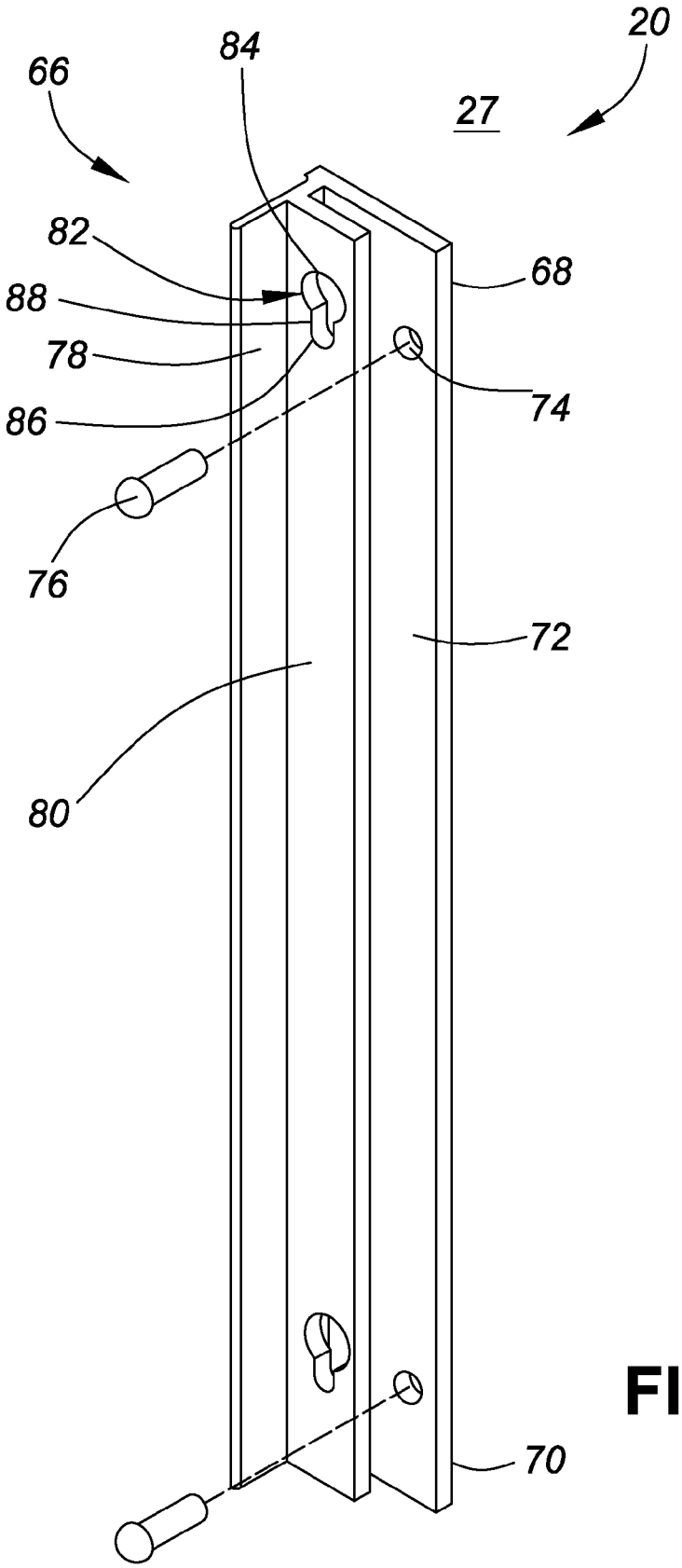
FIG. 8 is a front perspective view of one of the brackets of FIGS. 1, 2 and 4 to 7.

Referring back to FIG. 1, the bottle rack 20 has a pair of spaced-apart elongate brackets 66 and 67, for mounting to the wall 27 seen in FIG. 2. The brackets are extruded aluminium in this example. Each of the brackets 66 and 67 is substantially the same in parts and function and therefore only bracket 66 will be described in detail. As best seen in FIG. 8, each bracket has a first end 68 and a second end 70 spaced-apart from the first end. Each bracket 66 has wall-abutting portion 72 extending between ends 68 and 70 for connecting to the wall 27. The wall-abutting portion is a rectangular flange in this example. The wall-abutting portion 72 has a pair of spaced-apart apertures located adjacent to ends 68 and 70, as shown by aperture 74 for end 68. The assembly 20 has a pair of fasteners, in this example screws as shown by screw 76, that extend through the apertures 74 for connecting the brackets 66 to the wall 27.

Each bracket 66, 67 has a peripheral portion 78 connected to and extending outwards from its wall-abutting portion 72. In this example portion 78 extends perpendicular to portion 72. The peripheral portion 78 is a rectangular flange in this example. Each bracket 66, 67 has a panel-abutting portion 80 for connecting with a respective peripheral edge portion, such as portion 58 of panel 44 seen in FIG. 2. Panel-abutting portion 80 extends from the peripheral portion 78. Panel-abutting portion 80 is a rectangular flange in this example. Panel-abutting portion 80 is spaced-apart from and extends in parallel with the wall-abutting portion 72 in this example.

Figure 5:
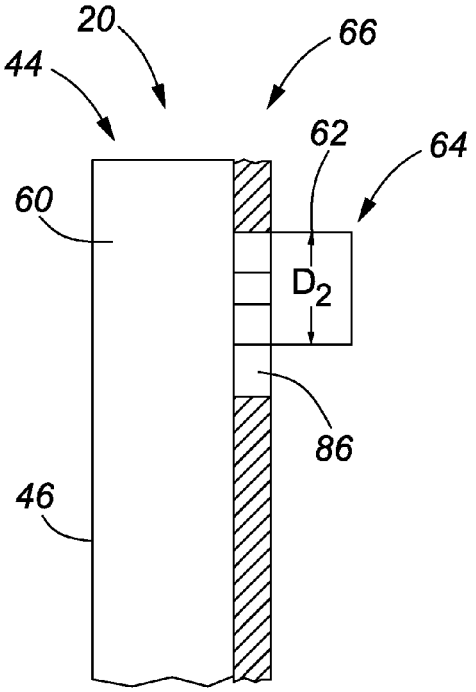
FIG. 5 is a fragmentary, side elevation view of the panel and bracket similar to FIG. 4, with the fastener head being disposed through the keyhole-shaped aperture.
Figure 6:
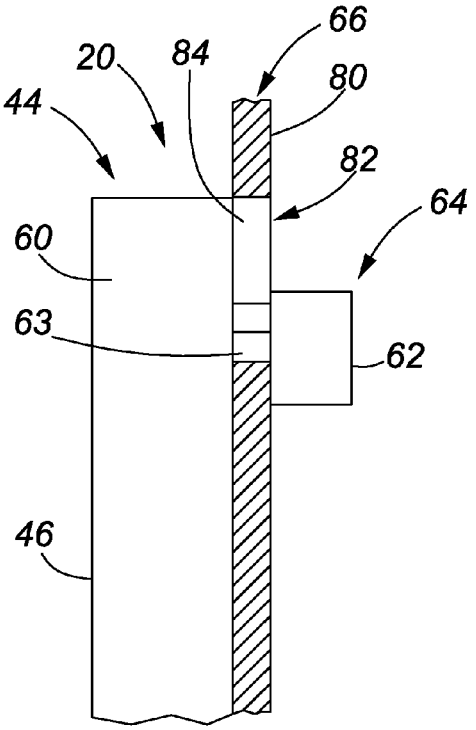
FIG. 6 is a fragmentary, side elevation view of the panel and bracket similar to FIG. 4, with the fastener head disposed through the keyhole-shaped aperture and secured in place.
Figure 7:
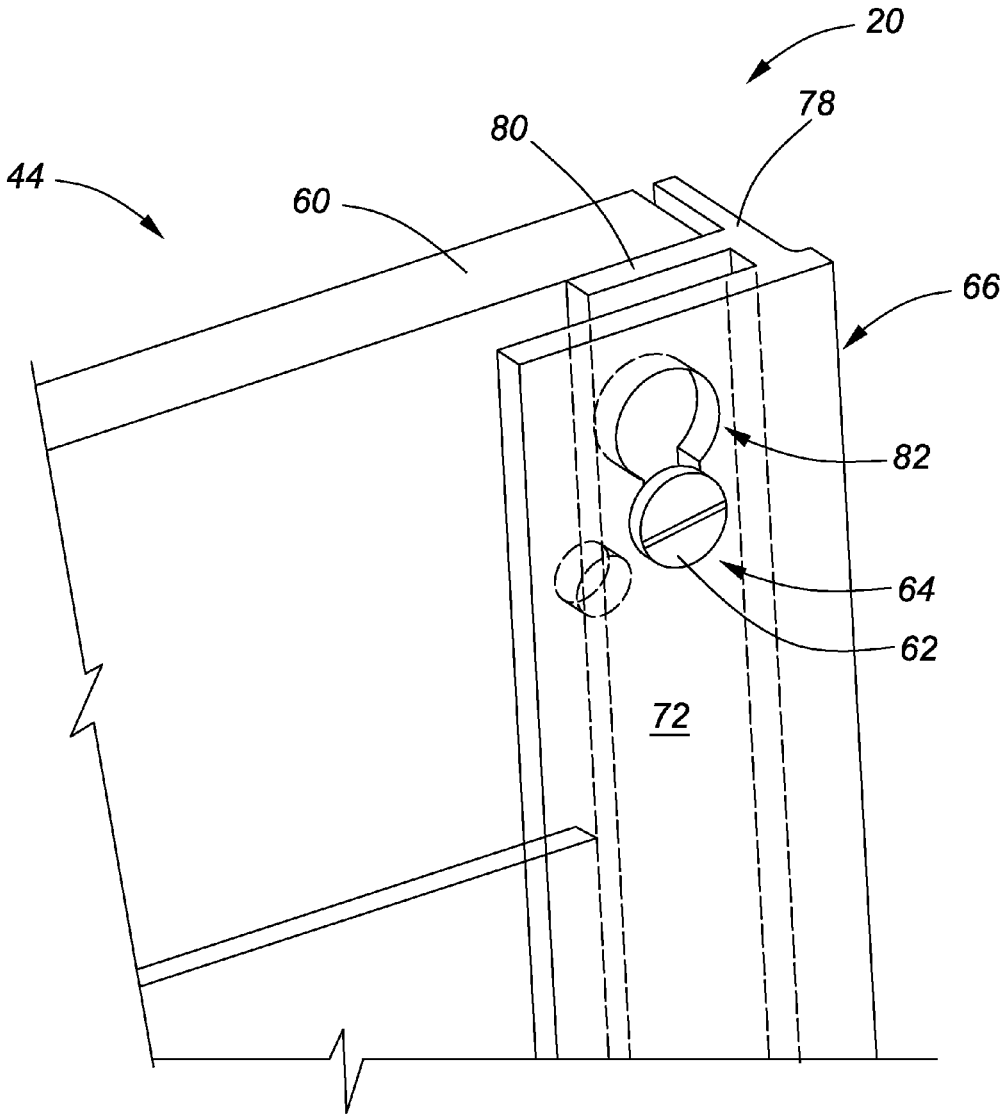
FIG. 7 is a fragmentary, rear perspective view of the panel and bracket of FIG. 6, with the fastener head disposed through the keyhole-shaped aperture and secured in place.

Each panel-abutting portion 80 has a pair of spaced-apart keyhole-shaped apertures positioned adjacent to ends 68 and 70 of bracket 66, respectively, as shown by aperture 82 positioned adjacent to end 68. Each of the apertures 82 has a circular section 84 shaped to receive fastener head 62 as seen in FIG. 5. Each of the apertures has a u-shaped section 86 shaped to receive the shaft 63 of screw 64, as seen in FIGS. 6 and 7. Referring to FIGS. 4 to 7, fastener heads 62 are positioned to selectively pass through sections 84 of apertures 82 to enable the panel 44 and panel-abutting portions 80 to abut. The panel 44 may then be lowered, with shafts 63 of screws 64 engaging portions 88 of the brackets 66 adjacent to sections 86 of apertures 82, seen in FIG. 8, for connecting the panel 44 to the brackets 66. Fastener heads 62 are thus insertable within the keyhole-shaped apertures 82 for selectively connecting the panel 44 to the brackets 66 and 67, as seen in FIGS. 6 and 7. Referring to FIG. 2, panel 44 thus selectively connects to, extends between and is supported by the brackets 66 and 67.

Figure 10:
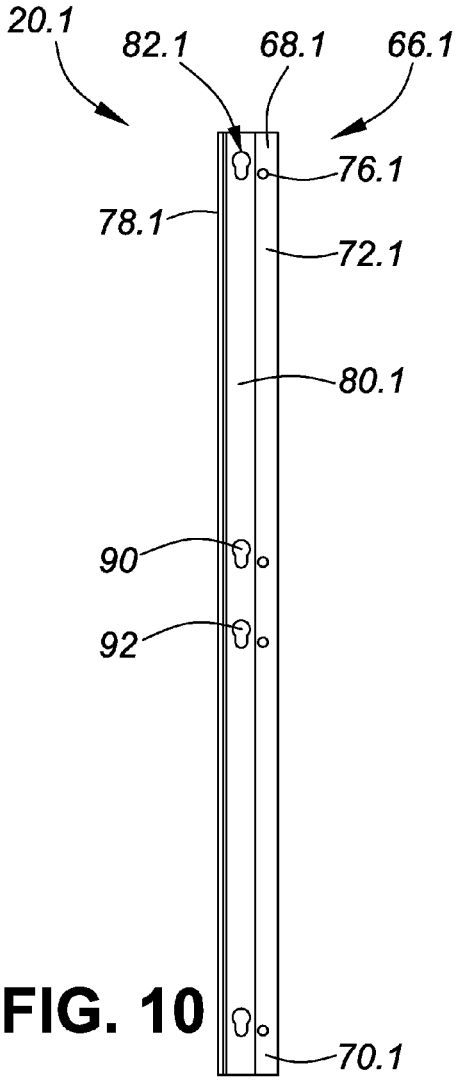
FIG. 10 is a front elevation view of a bracket similar to FIG. 8 for a bottle rack according to a second embodiment.

FIG. 10 shows an example of a bracket 66.1 for a bottle rack 20.1 according to a second embodiment. Like parts have like numbers and functions as the embodiment shown in FIGS. 1 to 9 with the addition of "0.1". Assembly 20.1 is substantially the same as assembly 20 shown in FIGS. 1 to 9 with the exception that brackets 66.1 are twice as long as brackets 66 shown in FIG. 8. Also, the brackets include a pair of centrally disposed keyhole-shaped apertures 90 and 92 extending through portion 80.1. Apertures 90 and 92 are positioned between ends 68.1 and 70.1 of the bracket.

Figure 11:
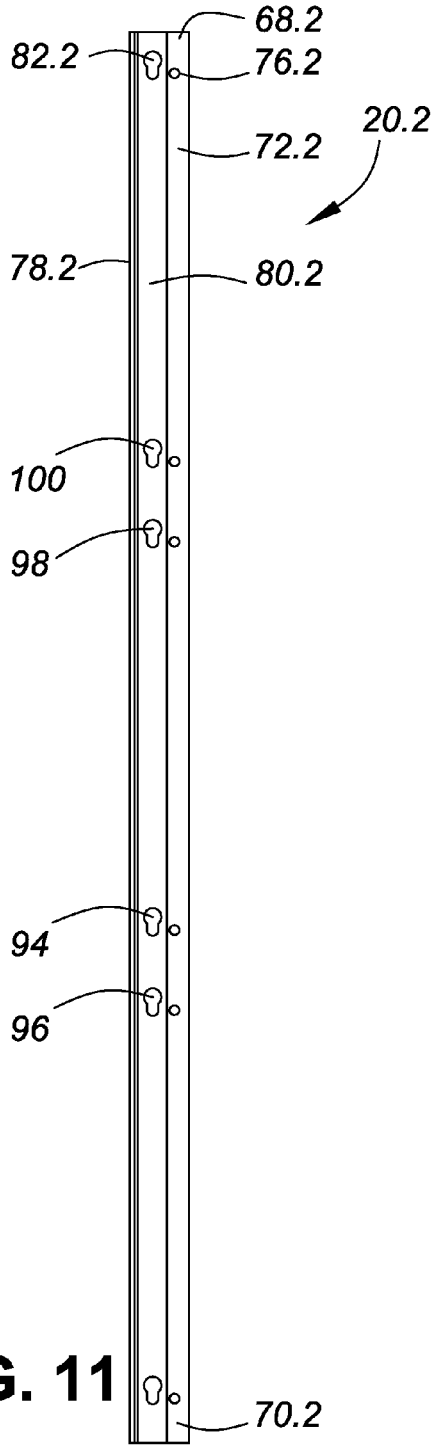
FIG. 11 is a front elevation view of a bracket similar to FIG. 8 for a bottle rack according to a third embodiment.

FIG. 11 shows an example of a bracket 66.2 for a bottle rack 20.2 according to a third embodiment. Like parts have like numbers and functions as the embodiment shown in FIGS. 1 to 9 with the addition of "0.2". Assembly 20.2 is substantially the same as assembly 20 shown in FIGS. 1 to 9 with the exception that brackets 66.2 are three times as long as brackets 66 shown in FIG. 8. Also, the brackets include two pairs of centrally disposed keyhole-shaped apertures 94 and 96 and 98 and 100, respectively, extending through portion 80.2. Apertures 94 and 96 are spaced-apart relative to end 70.2 at a distance approximately equal to one-third of the length separating end 70.2 of bracket 66.2 from end 68.2 of bracket 66.2. Apertures 98 and 100 are spaced-apart relative to end 68.2 at a distance approximately equal to one-third of the length separating end 70.2 from end 68.2. In this example the pairs of apertures are spaced-apart by approximately one foot from each other, though this is not strictly required.

The brackets as herein described may be available in various lengths to support one to five support panels aligned in a column one abutting the other, with keyhole apertures positioned aligning at respective corners of the panels, for example.

Figure 12:
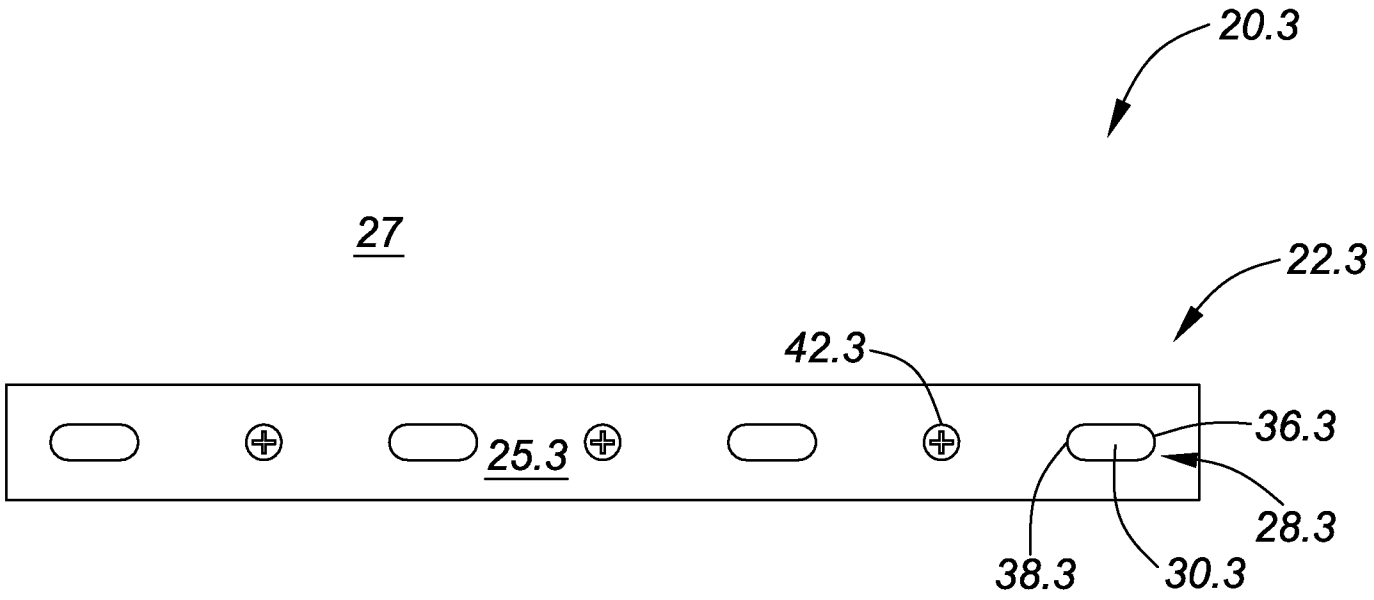
FIG. 12 is a front elevation view of a bottle rack according to a fourth embodiment.

FIG. 12 shows an example of a bottle rack 20.3 according to a fourth embodiment. Like parts have like numbers and functions as the embodiment shown in FIGS. 1 to 9 with the addition of "0.3". Assembly 20.3 is substantially the same as assembly 20 shown in FIGS. 1 to 9 with the exception that assembly 20.3 comprises only bottle-supporting member 22.3 and fasteners, in this example screws 42.3. Instead of using screws 42 to connect the plates 24 to the panel 44 as shown in FIGS. 1 to 9, in this case the panel and brackets are omitted and screws 42.3 connect plate 42.3 directly to wall 27.

The assembly 20 as herein described comprises an easy to assemble, space-efficient, versatile, and affordable modular system that is suitable for residential as well as commercial applications. Its design is optimized for mass production as well as shipping, making it affordable compared to other known products and appealing to end-customers, as well as value-added resellers and tradespersons.

The assembly 20 as herein described may be less expensive to fabricate because, for example, the brackets 66 and 67 may be made by anodized, extruded aluminium. Also, it is relatively cost efficient to weld support bars 28 to plate 24. This is in contrast to the relatively high costs of independently milled stainless steel rods and machining bolts as required by some earlier racks. The support bars 28 can similarly be extruded instead of milled and enjoy the same benefits.

The support bars 28 have a shape that is flatter compared to some racks that use round bars. The support bars having the flatter shape may require less material and may occupy less space, resulting in optimal bottle density and improved aesthetics imparted by the floating effect of the bottle arrangement.

The panel may vary in height and width, and may be as small as less than one foot in height and/or width, facilitating transportation of the assembly and a reduction of transportation costs. The brackets advantageously are configured to accommodate multiple panels. The modular design of the assembly 20 as herein described allows for a large number of configurations in terms of positioning and colour/finish combinations for the support bars and/or panels, while eliminating the need for custom fabrication or installation. The arrangement and positioning of the panels 44 and brackets 66 and 67 in FIG. 9 is shown by way of example only.

The brackets as herein described may minimize measuring time when installing the assembly 20, compared to some earlier racks. Also, the assembly as herein described may provide the advantage of minimizing the number of holes that must be drilled into the wall, because the panels 44 are hung onto the brackets and it is only the brackets that are screwed into the wall.

Because the bottle-supporting members 22 are fastened by screws passing through the rear 48 of the panel 44 as shown in FIG. 1, this may inhibit wobbling of the bottle-supporting members due to stripped threading that may otherwise occur if the bottle-supporting members were screwed in from the front 46 of the panel.

It will be appreciated that many variations are possible within the scope of the invention described herein. For example, instead of using brackets 66 and 67, the panel 44 may connect to the wall through a z-clip assembly extending from adjacent to peripheral edge portion 58 of panel 44 to adjacent to peripheral edge portion 59 of the panel seen in FIG. 1.

Instead of the support bars 28 being welded to their plates 24, alternatively, the supports bars and their respective plates may be molded as single pieces. These molded single pieces may be of metal or plastic, for example.

Instead of the support bars 28 being in cross-section rectangular with semicircular ends, alternatively, the support bars may be oval in cross-section, for example. In a further alternative, the support bars may have bevelled edges, for example.

The brackets may be shaped to have a length, width and integrity sufficient to support a plurality of magnum-sized wine bottles filled with wine.

Instead of being used for holding wine, in a further variation, the bottle-supporting members 24 may be omitted and the panels 44 may be integral with no apertures 50 and 52 seen in FIG. 1. In this configuration, the panels and brackets 66 and 67 may merely serve an aesthetic function.

Instead of brackets 66 and 67, mounting plates, made of metal for example, may be screwed into the wall, where the mounting plates each have a respective keyhole-shaped aperture for receiving the fastener heads of the panel 44.

Figure 25A:
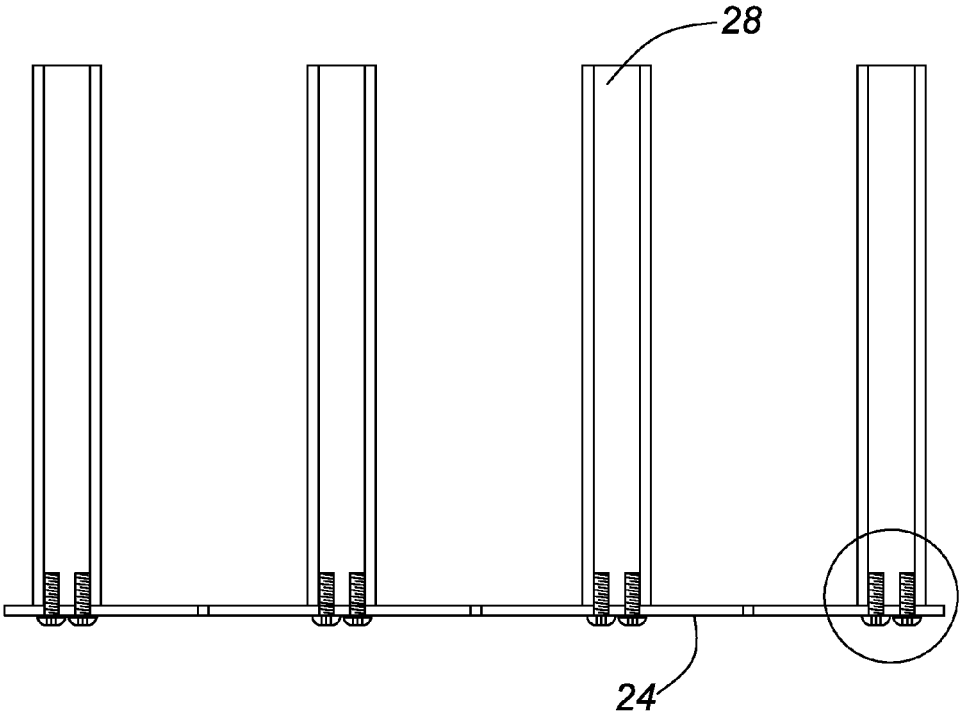
Figure 25B:
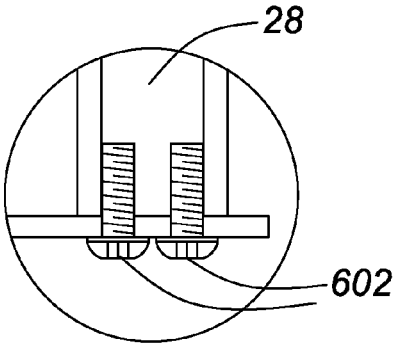

FIGS. 25A and 25B illustrate another embodiment in which the support bars 28 are connected to the elongate portion 24 with button-head screws, instead of by welding. In this embodiment, the elongate portion 24 does not have apertures 37 for the proximal ends of the support bars 28 to be inserted into and welded with. Instead, each of the support bars 28 is fastened onto the elongate portion 24 by at least one button-head screw (support bar fastener), and in the depicted exemplary embodiment two screws 602, which are screwed in from the rear side of the elongate portion 24.

Figure 26A:
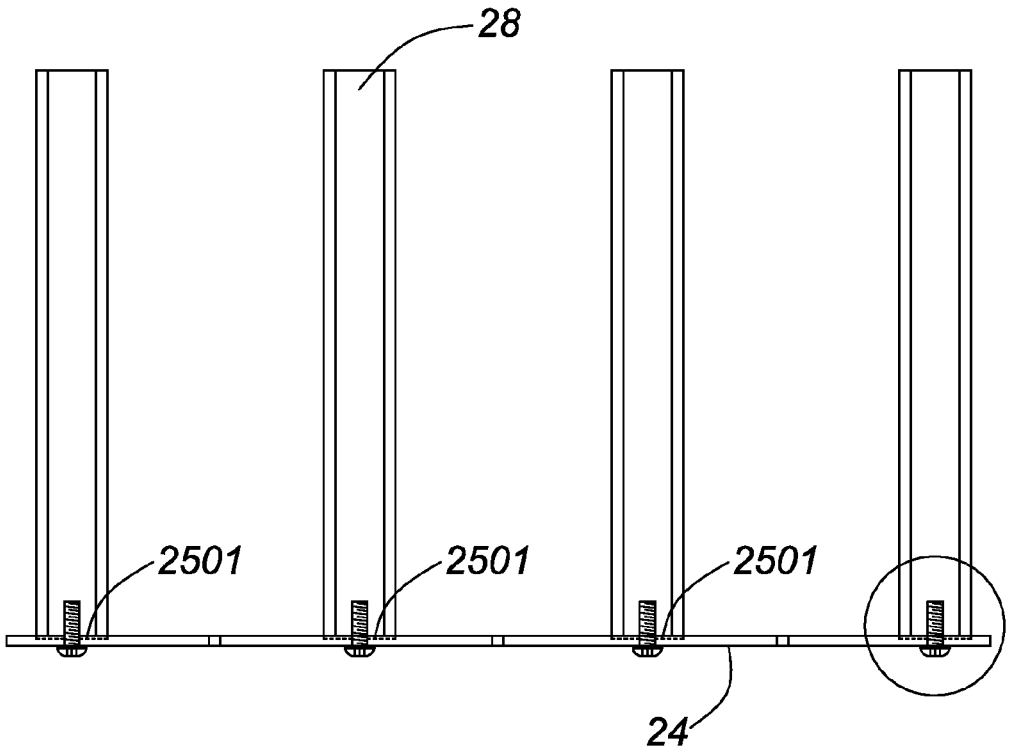
Figure 26B:
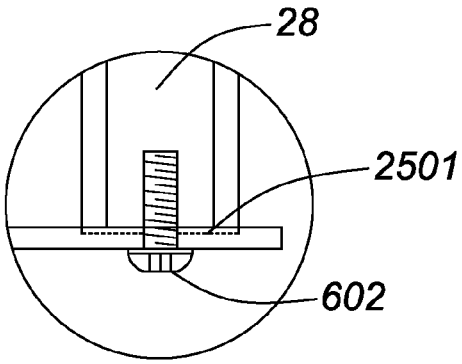

In addition, FIGS. 26A and 26B illustrate another embodiment in which the elongate portion 24 further comprises a plurality of bar slots 2501 spaced longitudinally along the elongate portion 24. The bar slots 2501 are formed on the front side of the elongate portion 24, which faces the panel 44 when the bottle rack 20 is assembled, and each of the bar slots 2501 is a recess that extends into but not through the front face of the elongate portion 24. Each of the bar slots 2501 is shaped to snugly receive the proximal end 29 of a support bar 28. In this way, when the support bars 28 are assembled onto the elongate portion 24, their proximal ends 29 are snugly held by the bar slots 2501 and thus one button-head screw 602 (support bar fastener) is sufficient to secure a support bar 28 without being concerned that torque applied to it by the bottles 34 will cause its rotation.

Figure 13:
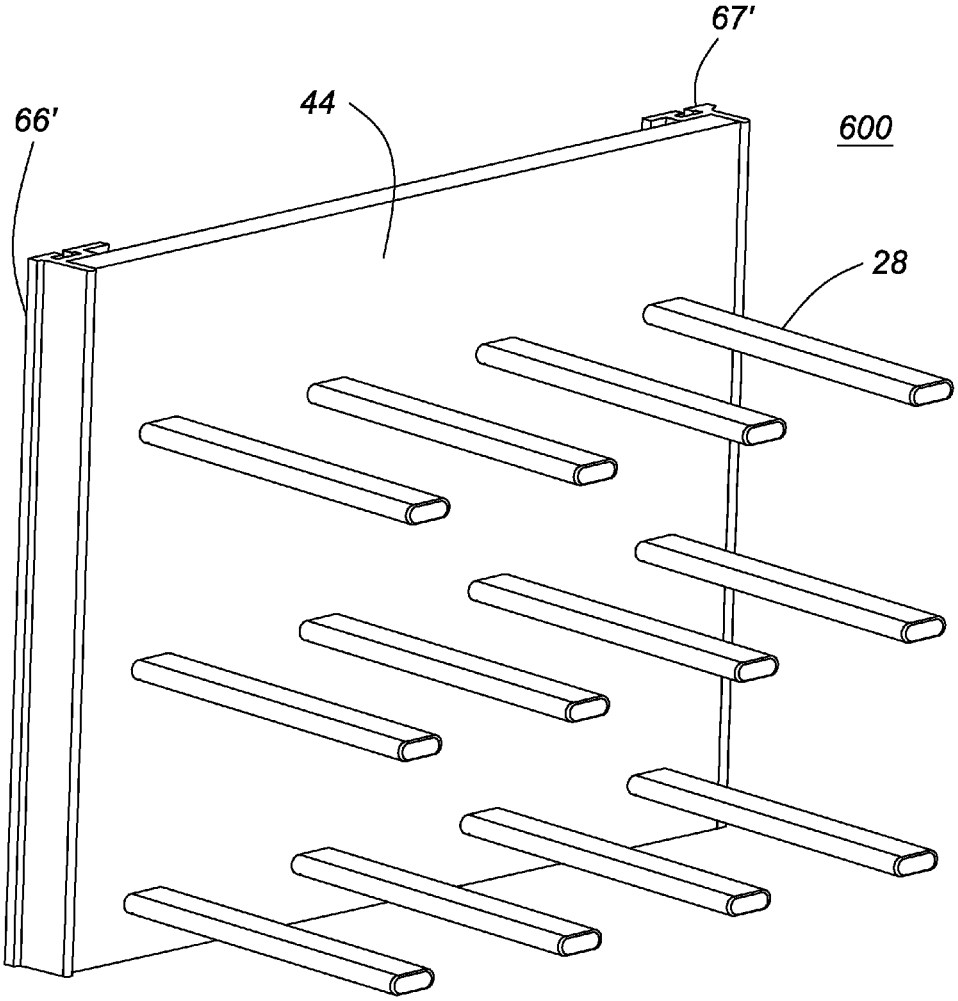
FIG. 13 is a perspective view of a wine rack according to a fifth embodiment viewed from the front side.
Figure 14:
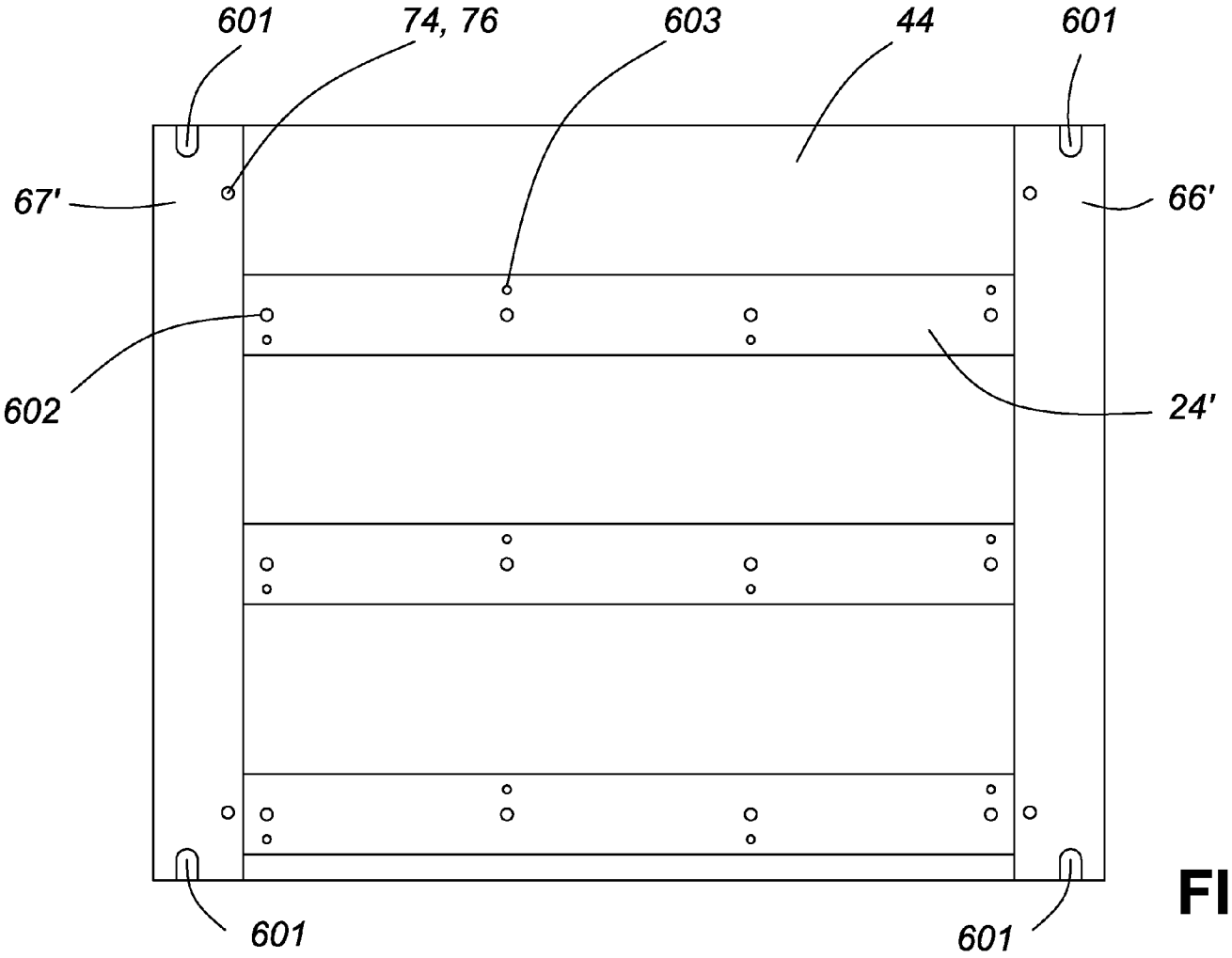
FIG. 14 is a rear view of the wine rack of FIG. 13.
Figure 15:
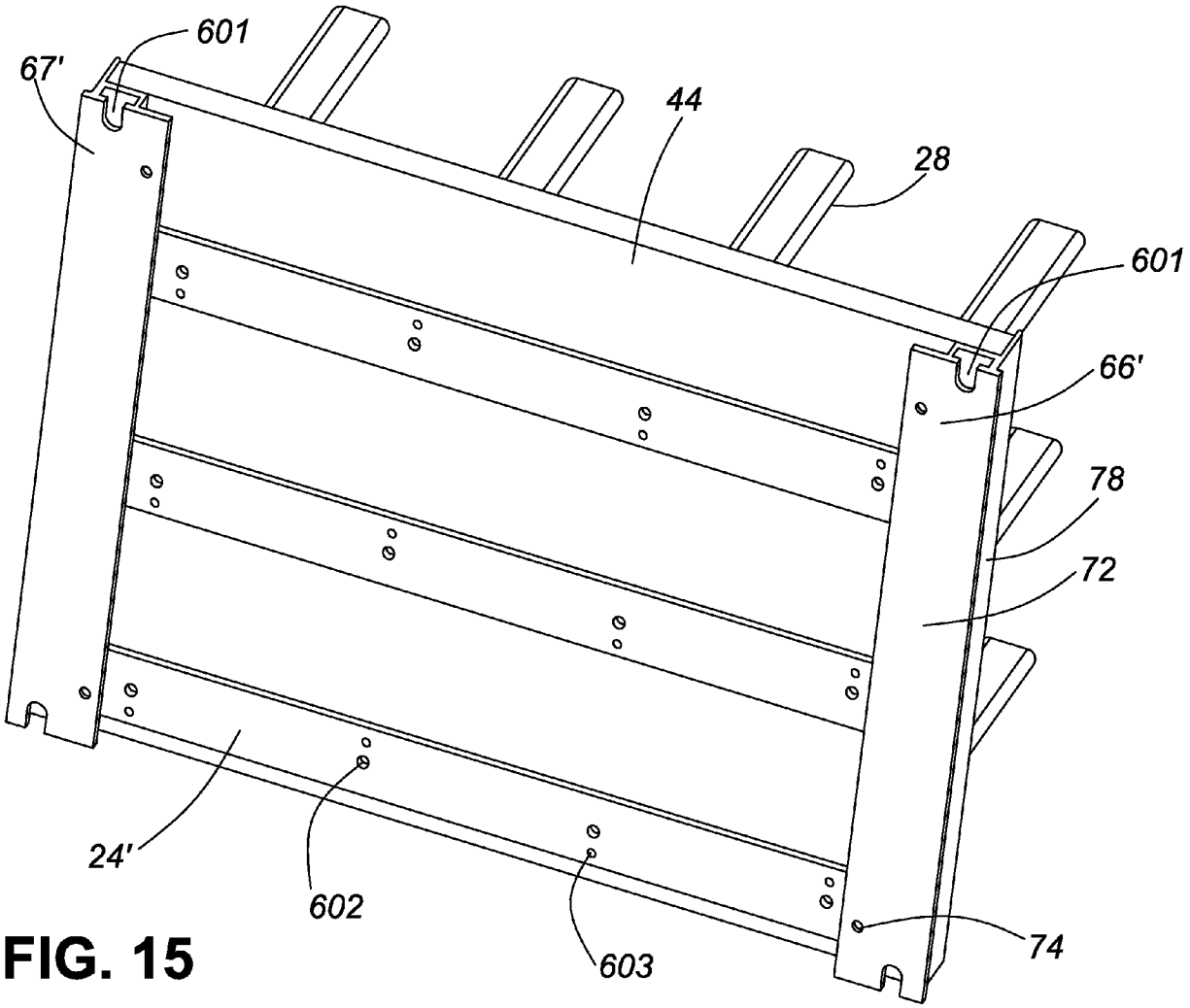
FIG. 15 is a perspective view of the wine rack of FIG. 13 viewed from the rear side.

FIGS. 13 to 15 illustrate the bottle rack 20 according to another embodiment. Components similar to the above embodiments are assigned the same numbers, and their descriptions are omitted to avoid redundancy. As shown in these figures, the wine rack 600 comprises a panel 44, first and second mounting brackets 66', 67' and at least one bottle-supporting assembly 22' (in this example three bottle-supporting assemblies 22').

Each bottle-supporting assembly 22' has an elongate portion 24', which is rectangular in this example. The elongate portion 24' has a front side facing the panel 44 and a rear side facing a wall. The bottle-supporting assembly 22' has a plurality of support bars 28, in this example four bars 28 spaced longitudinally along the elongate portion 24' and suitable to support bottles therebetween.

The support bars 28 are positioned such that a bottle 34 can rest on horizontally adjacent support bars 28, such as wine bottles 34, therebetween. The support bars 28 in this example each have a cross-section in the shape of a rectangle having a pair of semicircular ends. The support bars 28 are shaped to substantially abut and extend along the length of the lower portion 32 of the bottle. Each support bar 28 has a pair of spaced-apart, peripheral rounded edges, upon which the bottles rest.

Figure 16A:
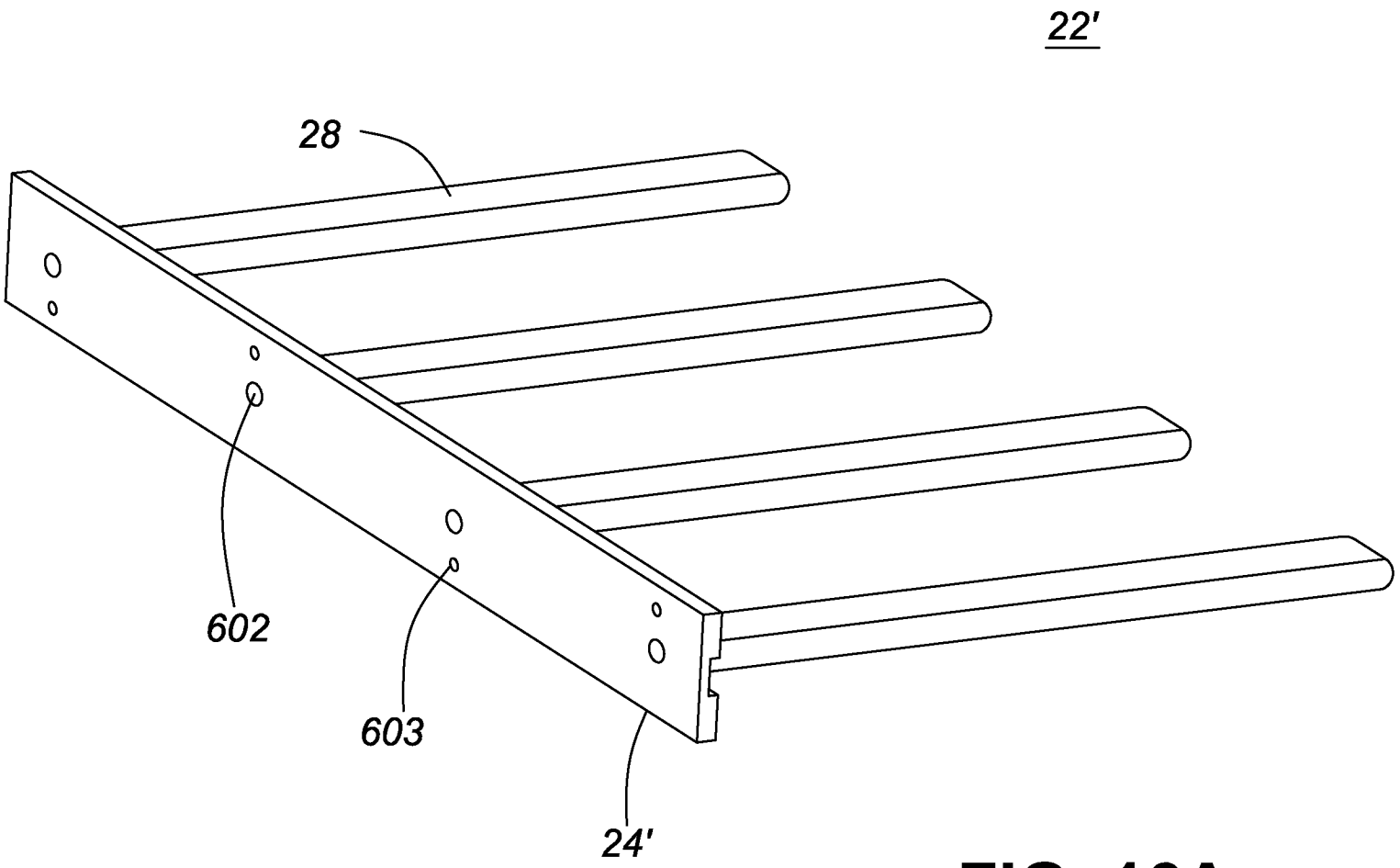
FIGS. 16A and 16B are perspective views of a bottle-supporting assembly that can be used in the wine rack according to a sixth embodiment.
Figure 16B:
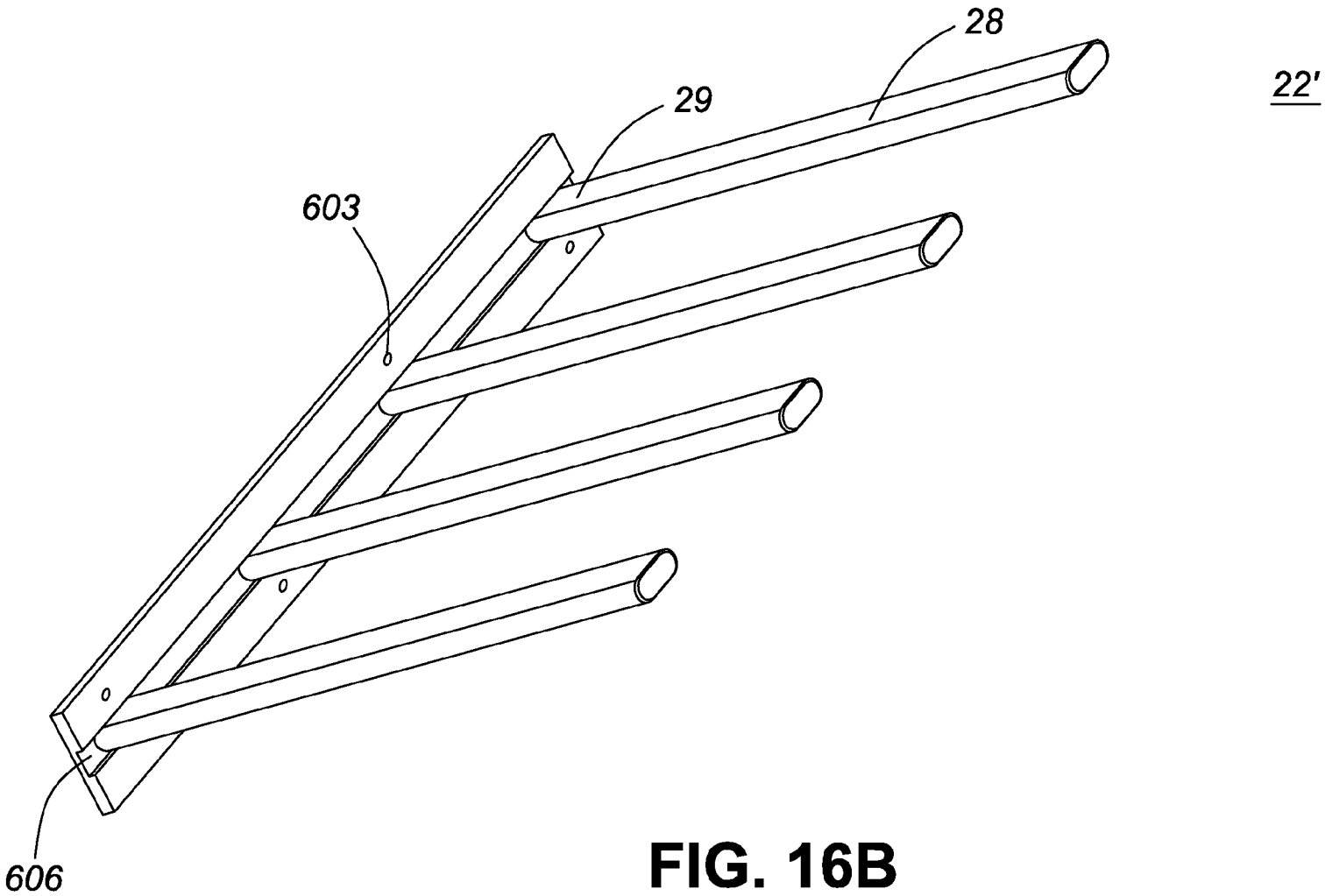

FIGS. 16A and 16B illustrate the bottle-supporting assembly 22' in detail. As shown in FIG. 16B, the elongate portion 24' has a groove 606 on its side facing the panel 44 (the front side). The groove 606 extends longitudinally along the elongate portion 24' and is positioned roughly equidistant between the longitudinal edges of the elongate portion 24'. The groove 606 is shaped to snugly receive the proximal end 29 of the support bars 28. In the embodiment depicted in FIGS. 26A and 26B, each of the bar slots 2501 is a segment of the groove 606 having a length equal to the width of the support bar 28 that is inserted into the bar slot 2501.

As shown in FIG. 16A, the bottle-supporting assembly 22' further comprises a plurality of support bar fasteners 602 that fasten the support bars 28 to the elongate portion 24'. In this example, each of the support bar fasteners 602 is a screw that screws into a support bar 28 from the rear side of the elongate portion 24' with the proximal end 29 of the support bar 28 inserted in the groove 606.

In this embodiment, the groove 606 snugly receives the proximal ends 29 of the support bars 28, thereby prohibiting rotation of the support bars 28. As a result, one screw suffices to secure a support bar 28 to the elongate portion 24'.

As shown in FIGS. 14, 15 and 16A, the elongate portion 24' of the bottle-supporting assembly 22' has two parallel edges extending along its longitudinal direction. The elongate portion 24 further comprises a plurality of assembling apertures 603 spaced longitudinally along the elongate portion 24', and positioned along the two parallel edges so that every other one of the assembling apertures 603 along the elongate portion 24' is on the same side of the elongate portion 24'. In this way, when the bottle rack 20 is assembled by screwing assembling fasteners through the assembling apertures 603 from the rear side of the elongate portion 24' and into the rear side of the panel 44, the embodiment of the bottle-supporting assembly 22' of FIGS. 14, 15, and 16A has improved vertical stability relative to the embodiment of the assembly 22 shown in FIGS. 2 and 3. Unlike the embodiment shown in FIG. 2, in this embodiment the panel 44 does not have recessed portions 53 to allow the rear of the elongate portion 24' to be flush with the rear of the panel 44 when the bottle rack 20 is assembled.

The wine rack 600 further comprises a pair of mounting brackets 66' and 67', for mounting to the wall. The brackets 66', 67' are extruded aluminium in this example. The mounting brackets 66' and 67' are substantially symmetric in structure to each other and have the same function. Similar to the above embodiments, each of the mounting bracket 66', 67' has two ends and a wall-abutting portion extending between the two ends for connecting to the wall. The wall-abutting portion has a pair of wall-mounting apertures 74 for insertion of a pair of fasteners 76, in this example screws, thereby connecting the mounting brackets 66' 67' to the wall. While the wall-mounting apertures 74 shown in FIGS. 14, 15 and 24 are round, they can be "pill-shaped", namely rectangular with rounded edges, as shown in FIGS.

18 to 23. This allows for a greater tolerance when mounting the bottle rack 600 with fasteners like screws onto the wall.

Each of the mounting bracket 66', 67' has a peripheral portion 78 connected to and extending outwards from the wall-abutting portion 72, and a panel-abutting portion 80 for connecting with a respective peripheral edge portion of the panel 44. The panel-abutting portion extends from the peripheral portion.

Figure 24:
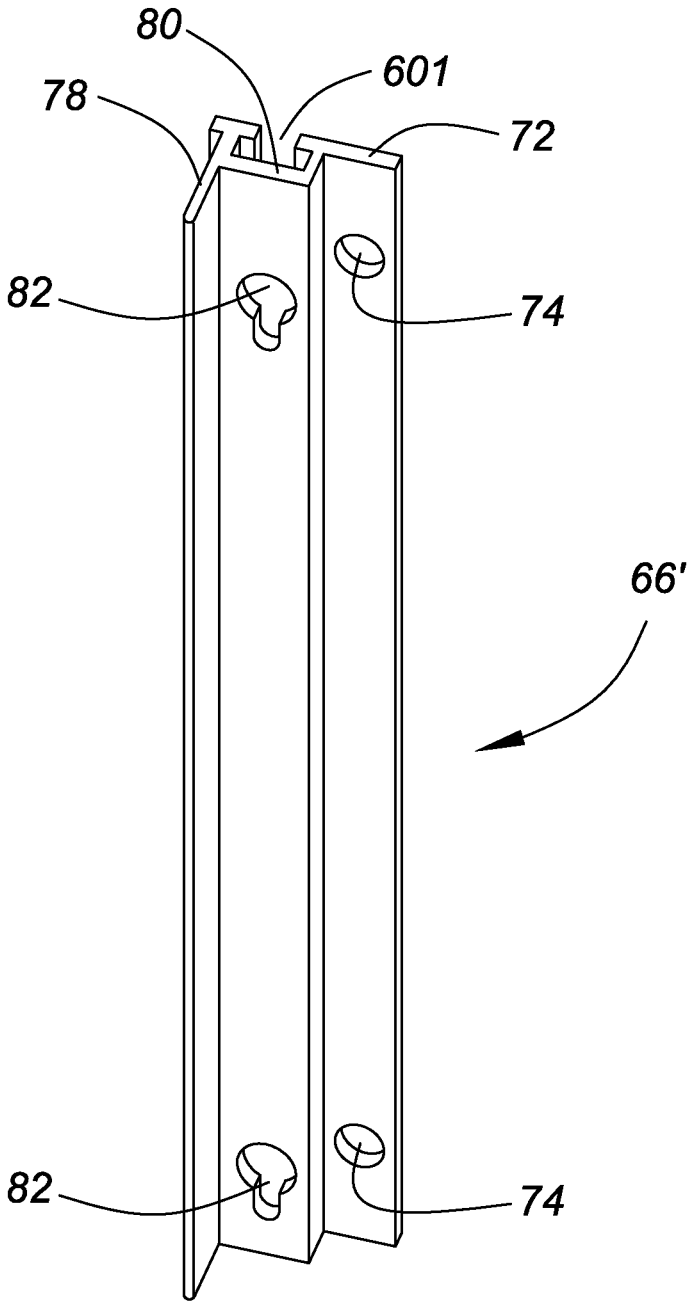
FIG. 24 is a perspective view of a mounting bracket that can be used to mount a panel of the wine rack to a wall according to an eighth embodiment.

As shown in FIG. 24 and similar to the above embodiments, the panel-abutting portion of the mounting bracket 66', 67' has at least one, and in this example a pair of, keyhole-shaped panel-abutting apertures 82. Each of the panel-abutting apertures 82 has a circular section and a u-shaped section such that fastener heads of the panel 44 can be aligned with the circular sections of the apertures 82 when the panel 44 is being pushed towards the wall and the fastener heads are accordingly being inserted into the apertures 82 until the panel 44 and panel-abutting portions of the mounting brackets 66', 66' abut, and the panel 44 can then be lowered and the shafts of the fasteners can slide into the u-shaped section to subsequently laterally restrain the panel 44, as described above with respect to FIG. 8.

Figure 17:
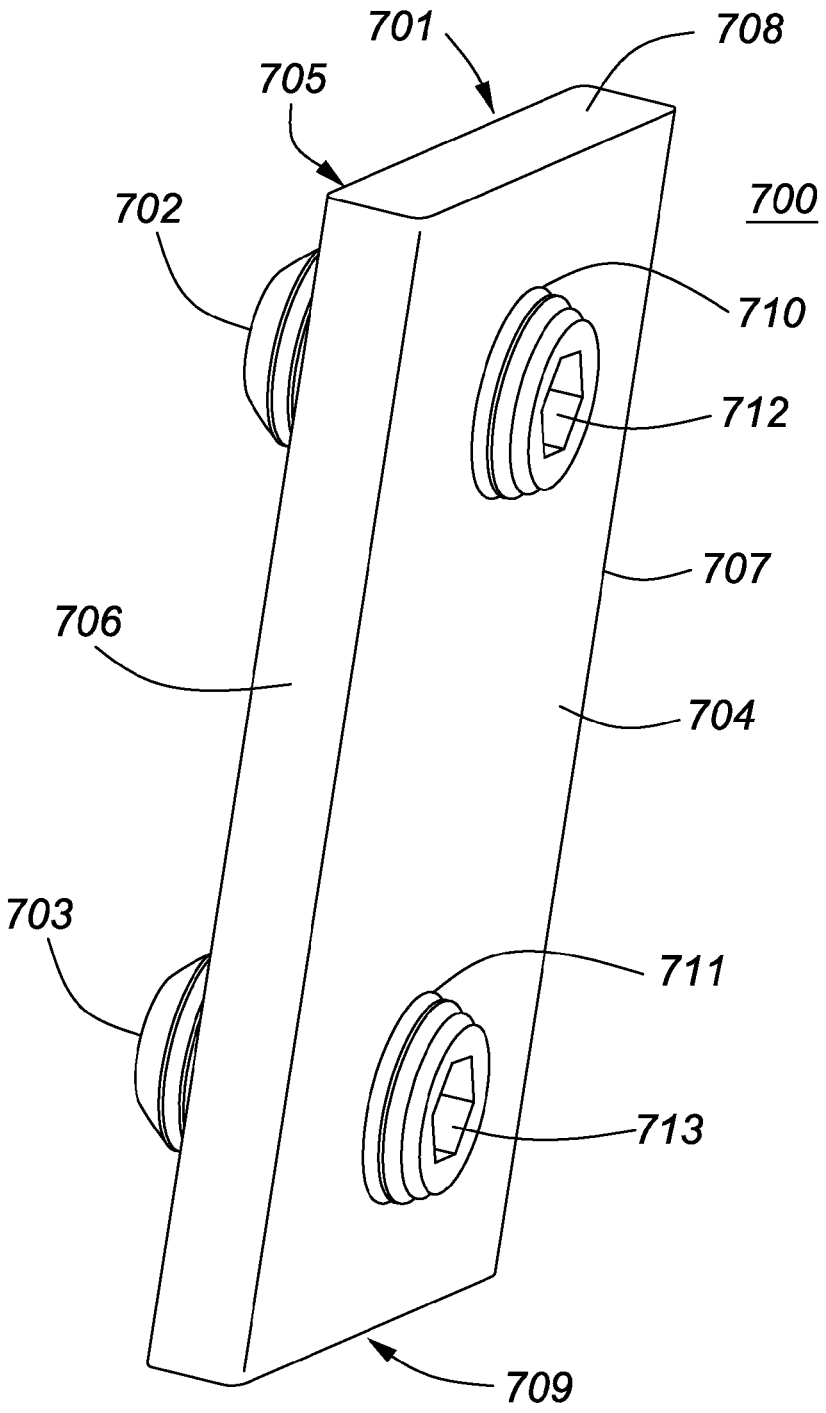
FIG. 17 is a perspective view of a link mechanism that can be used to link two mounting brackets of the wine rack according to a seventh embodiment.
Figure 18:
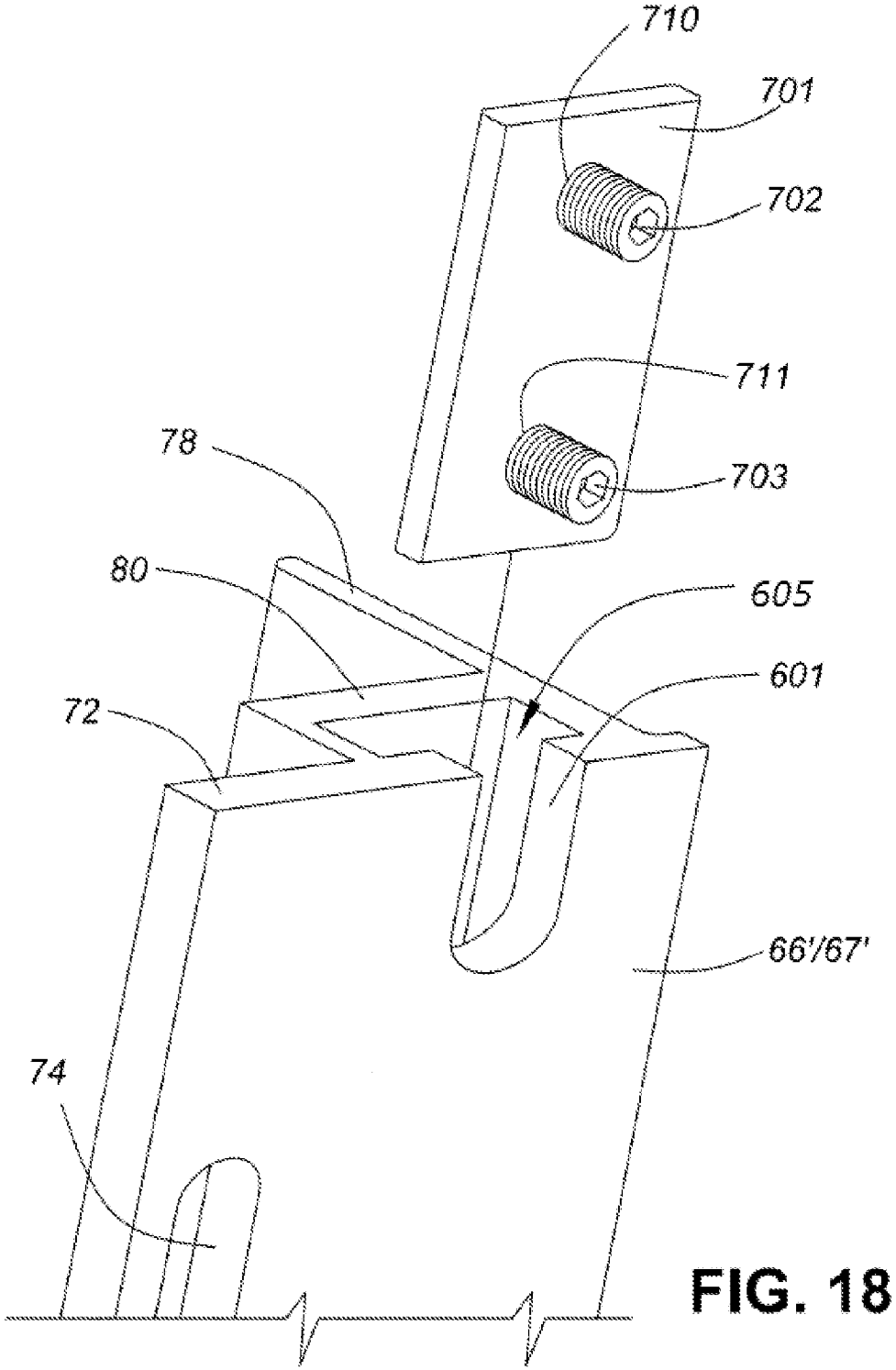
FIGS. 18 to 23 are perspective views depicting the process of using the link mechanism of FIG. 17 to link two mounting brackets of the wine rack.

The wine rack 600 may be modular and thus comprise a plurality of bottle-supporting assemblies 22', mounting brackets 66', 67', and respective modular panels 44 therefor. FIG. 17 shows a link mechanism 700 for linking the mounting brackets 66'/67' of adjacent modular panels 44 according to an embodiment. FIGS. 18 to 23 illustrate how the link mechanism 700 works. Components similar to the above embodiments are assigned the same numbers, and parts of their descriptions are omitted to avoid redundancy.

Compared to the embodiment of FIG. 1, the mounting brackets 66', 67' have a link opening 601 on each of their ends, which is "pill shaped" , as shown in FIGS. 14, 15 and 24. The link mechanism 700 comprises a link plate 701 that is substantially rectangular in shape and has planar front and rear sides 704, 705, a pair of parallel longitudinal edges 706, 707, and two ends 708, 709. The link plate 701 has two link apertures 710, 711 extending through the plate body between the front and rear sides 704,705. The link apertures 710, 711 are spaced longitudinally along the link plate 701 and positioned along a longitudinal axis that bisects the link mechanism 700 between the two longitudinal edges 706, 707. The link apertures 710 are threaded. The link mechanism 700 further comprises two link screws 702, 703 that are suitable to screw in and engage with the threaded link apertures 710, 711. Each of the link screws 702, 703 has a hexagonal socket 712, 713 in its head suitable to receive a hex key or Allen key (not shown).

As shown in FIGS. 18 to 21, the mounting bracket 66', 67' has a channel 605 between the wall-abutting portion 72 and the panel-abutting portion 80. The link plate 701 is sized so that one of its ends 708,708 can fit into the channel 605. In the depicted embodiment, the mounting brackets 66', 67' are extruded and the channel 605 according extends between the mounting brackets' 66', 67' ends. Because the channel 605 is extruded, in the depicted embodiment it also has a uniform cross-section throughout. In alternative embodiments (not depicted) in which extrusion is not used, the channel may have a different appearance. The wall-abutting and panel-abutting portions are parallel in the depicted embodiments, although in alternative embodiments they need not be.

Figure 19:
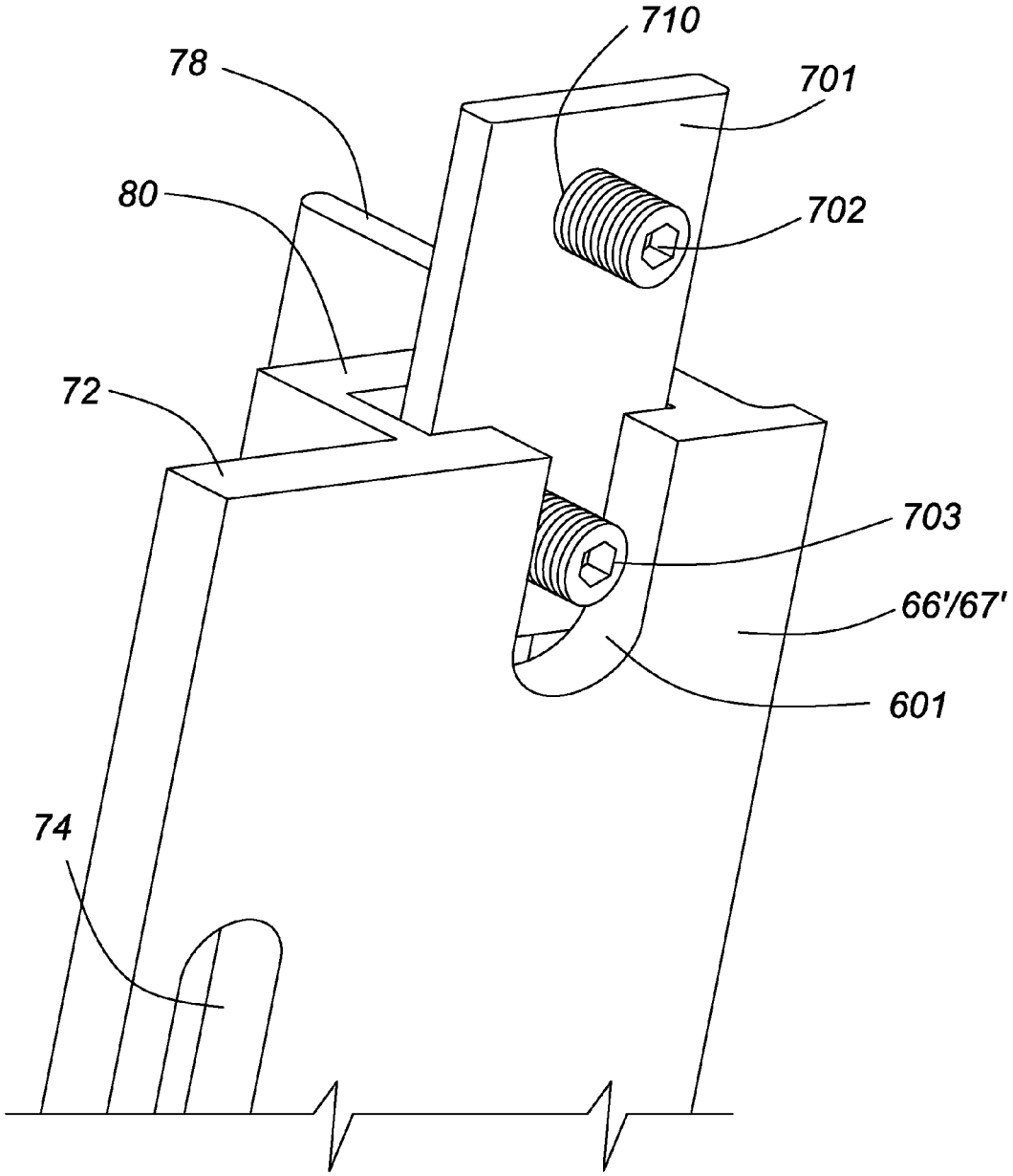

FIGS. 18 to 23 illustrate the process of using the link mechanism 700 to link two mounting brackets 66'/67' of the wine rack. First, the link plate 701 is inserted into the channel 605 between the wall-abutting portion and the panel-abutting portion 80 of the first mounting bracket 66'/67' to the extent that one of the link apertures 711 is within the first mounting bracket 66'/67', while the other link aperture 710 is outside of the first mounting bracket 66'/67', as shown in FIG. 19. At this stage, the two link screws 702, 703 are respectively screwed through the two link apertures 702, 703 but not to the extent that they prohibit insertion of the link plate 701 into the first mounting bracket 66'/67'. The link screws 702, 703 are screwed from a side of the link plate facing the wall-abutting portion. As a result, the head of the link screw 703 is located within the pill-shaped opening 601 of the first mounting bracket 66'/67'.

Figure 20:
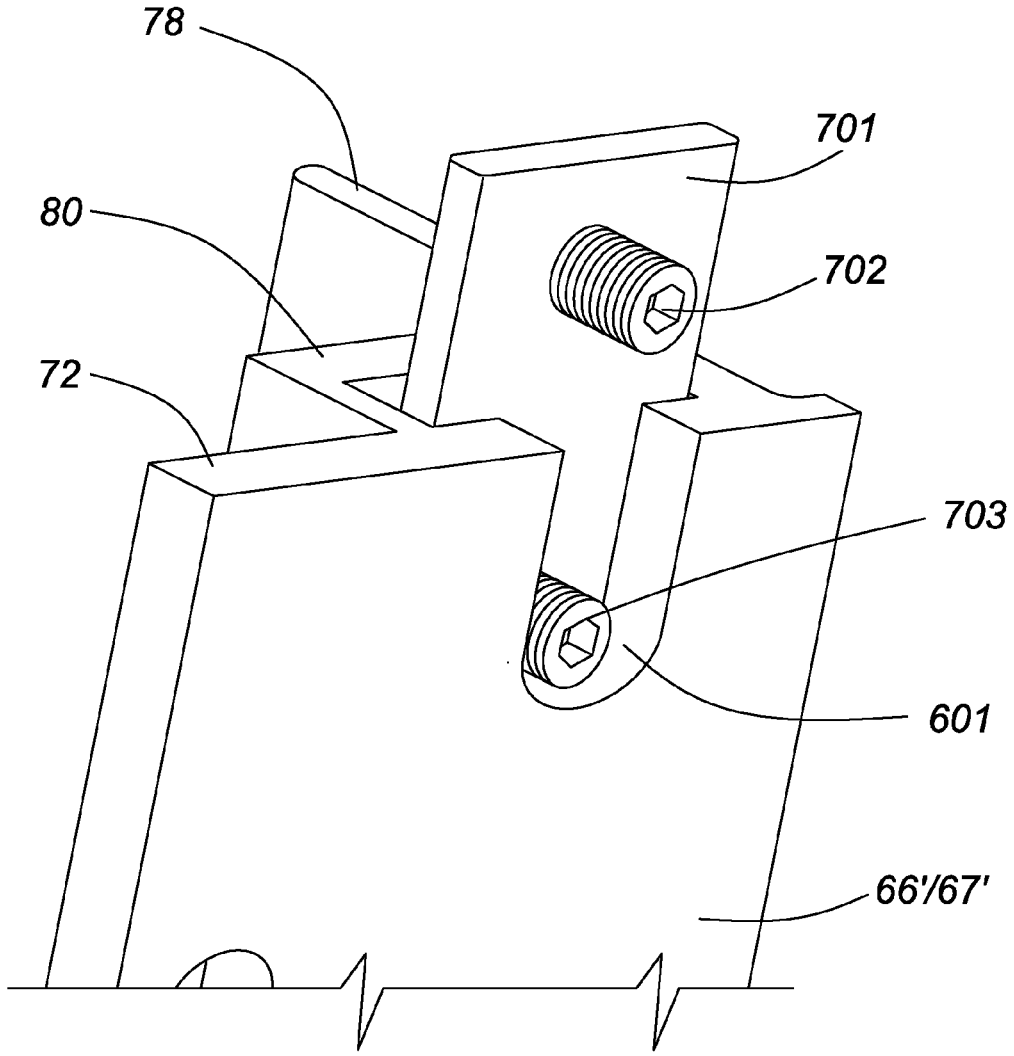

Once inserted into the pill-shaped opening 601 and the link screw 703 is in the channel 605 of the first mounting bracket 66'/67', it is screwed further in by using a hex key via the pill-shaped opening 601 until the tail of the link screw 703 is securely screwed into the panel-abutting portion 80 of the first mounting bracket 66'/67'. The link screw 703 consequently presses the link plate 701 securely into the wall-abutting portion of the first mounting bracket 66'/67'. Once secure, the link mechanism 700 is secured in the channel 605 of the first mounting bracket 66767' with one of the link apertures 710, one of the link screws 702 and about half of the link plate 701 extending out of the first mounting bracket 66'/67', as shown in FIG. 20.

Figure 21:
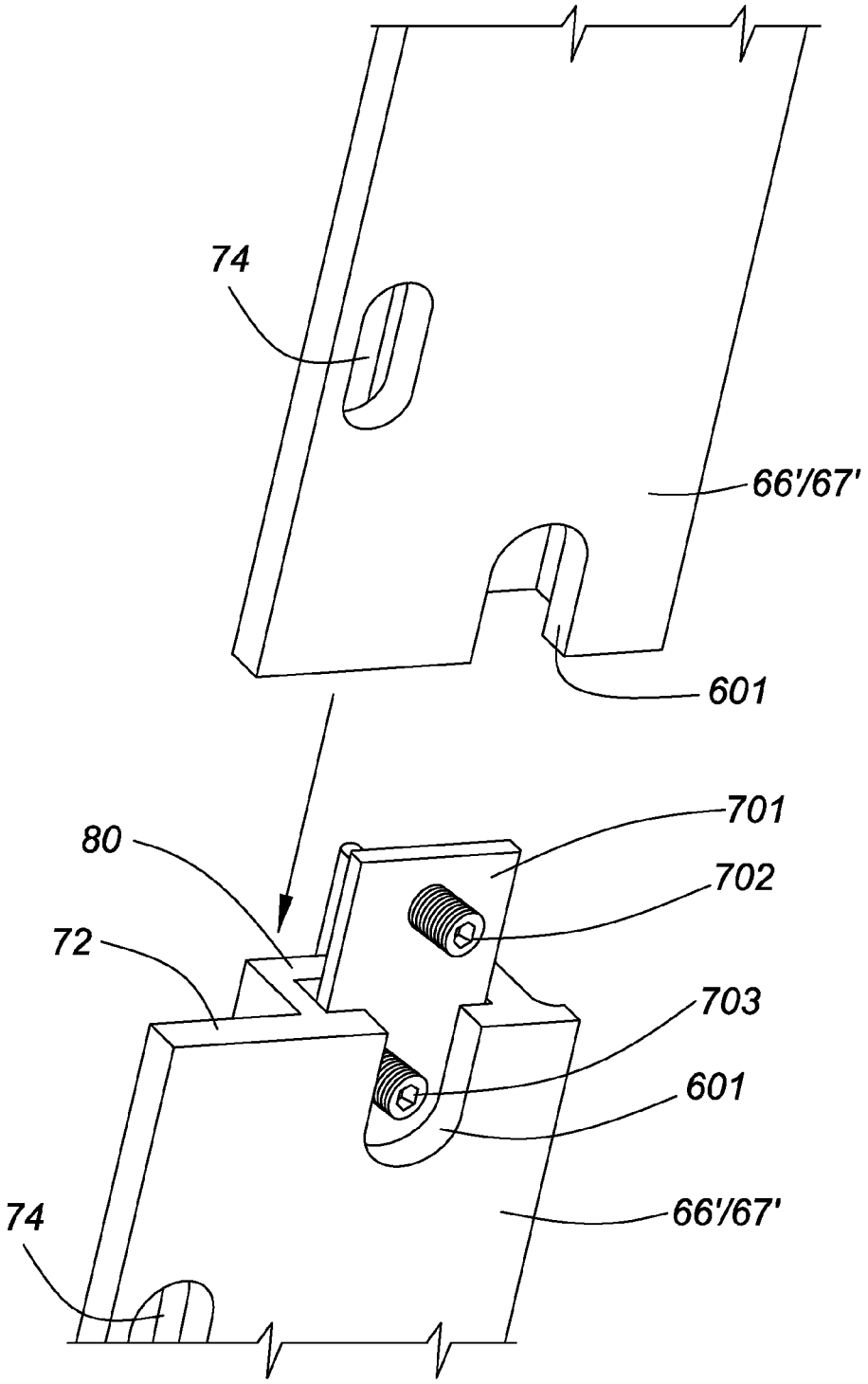
Figure 22:
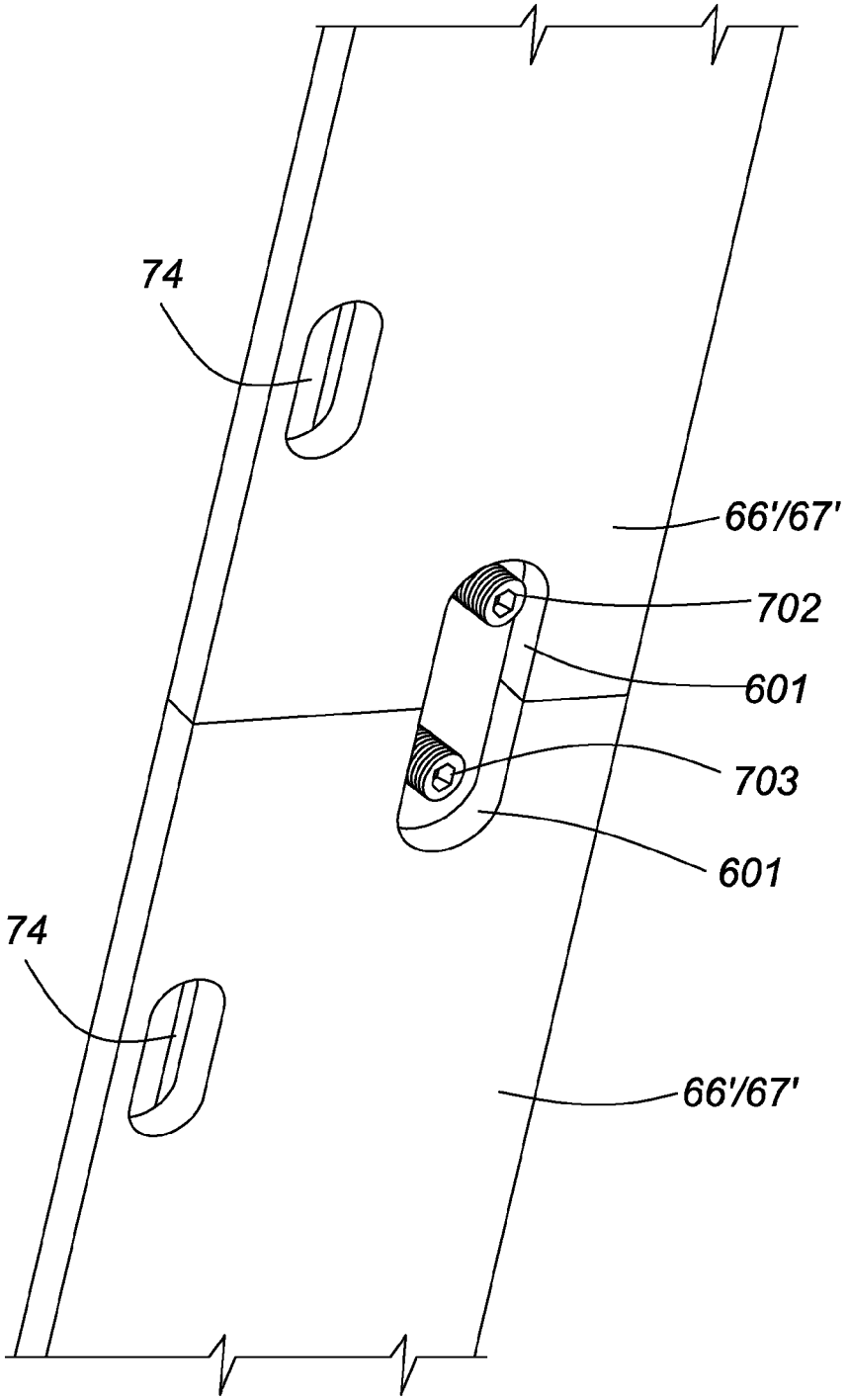
Figure 23:
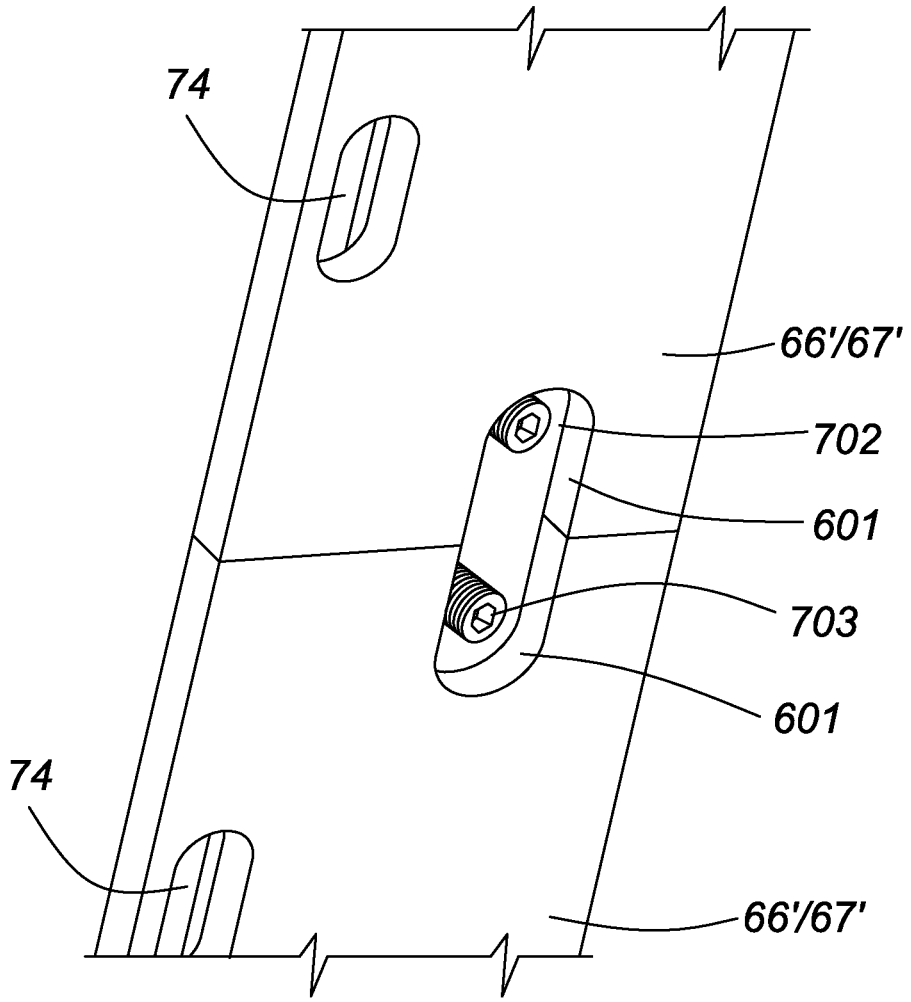

After being secured to the first mounting bracket 66'/67', the portion of the link plate 701 that extends out of the first mounting bracket 66'/67' is inserted into the channel 605 of the second mounting bracket 66'/67' until the ends of the first and second mounting brackets 66'/67' abut each other, as shown in FIGS. 21 and 22. Similar to the process described with respect to the first mounting bracket 66'/67' above, the head of the link screw 702 is located within the pill-shaped opening 601 of the second mounting bracket 66'/67'. The tail of the link screw 702 faces the panel-abutting portion 80 of the second mounting bracket 66'/67'.

The link screw 702 is then screwed further in by using a hex key, via the pill-shaped opening 601, until the tail of the link screw 702 is forced against the panel-abutting portion 80 of the second mounting bracket 66'/67'. The link plate 701 is consequently pressed against the wall-abutting portion of the second mounting bracket 66'/67', and the link mechanism 700 is accordingly secured in the channel 605 of the second mounting bracket 66'/67', as shown in FIG. 20. In this way, the link mechanism 700 securely connects the first and second mounting brackets 66'/67'.

In this embodiment, adjacent panels 44 can be connected together via the link mechanism 700. This eliminates the need for various lengths of mounting brackets, improves the ease of assembly, and allows all required components to be shipped in a single box. Connecting the panels 44 may aid structural stability, as load forces are distributed throughout the connected panels 44 via the mounting brackets and then to a relatively large portion of the wall, as opposed to being isolated to a single one of the panels 44 and then to a relatively small portion of the wall, which may be detrimental if that particular panel 44 is attached to a portion of a wall that is relatively weak.

According to another embodiments, a kit for a bottle-supporting assembly for use in a bottle rack can be prepared and shipped to the customer separately instead of being assembled and shipped together with other components of the bottle rack. The kit can comprise: at least one of the elongate portion 24, 24', a plurality of support bars 28 and a plurality of support bar fasteners 602, as described in the above embodiments. The support bar fasteners 602 are inserted into the elongate portions 24, 24' through fastener apertures in the elongate portions 24, 24'. Because the support bars 28 are not inserted all the way through the elongate portions 24, 24', the fastener apertures have a cross-sectional profile that prevents the support bar 28 connected via that fastener aperture from being inserted through that fastener aperture. Shipping the kit allows the bottle-supporting assembly to be economically packed and distributed for assembly at home, by distributors, or by retailers. Shipping a kit allows the bottle-supporting assembly to be assembled on-site, and/or pre-assembled before being shipped out. The kit can accordingly be shipped to resellers unassembled, which permits economical shipping and distribution relative to shipping and distribution of a fully assembled bottle rack. In this way, resellers may be able to fabricate custom panels that are made to order on-site by using the kits. In this way the kit can be used as part of a turn-key solution to the problem of economically and efficiently building wine racks. The kit can accordingly save custom wine cellar builders money compared to how much they have to pay when creating their own racks, while offering a superior solution in terms of versatility, aesthetic and functional appeal versus conventional.

While in the above embodiments, the elongate portions are horizontally oriented in the wine rack after installation, they can also be vertically oriented. In the vertical elongate portion arrangement, the support bars 28 need to be rotated about 90 degree along their longitudinal axes in each bottle-supporting assembly, so that the longitudinal sides of the support bars are horizontal and the bottle can rest on a pair of peripheral rounded edges of the support bars of adjacent bottle-supporting assemblies.

It is noted that the above-described embodiments can be used to support and store various kinds of bottles, not only wine bottles. The space between adjacent support bars can be adjusted according to the size of the bottle.

While particular embodiments have been described in the foregoing, it is to be understood that other embodiments are possible and are intended to be included herein. It will be clear to any person skilled in the art that modifications of and adjustments to the foregoing embodiments, not shown, are possible.

What is claimed:

1. A bottle rack comprising:

a bottle-supporting assembly having an elongate portion and a plurality of support bars welded to and cantilevered from the elongate portion, wherein the support bars are spaced longitudinally along the elongate portion; and a panel having a plurality of support bar apertures suitable for the support bars of the bottle-supporting assembly to extend through, wherein the bottle-supporting assembly is secured onto the panel with the support bars extending through the apertures of the panel and wherein the support bars are suitable to support bottles therebetween from the panel to ends of the support bars spaced from the panel such that the longitudinal axis of each of the bottles is substantially parallel to the support bars, wherein:

(a) the elongate portion has a first side facing the panel, and the support bars are aligned in a row along the elongate portion and are substantially perpendicular to the first side of the elongate portion;

(b) each of the support bars has a first end;

(c) the elongate portion has a plurality of second apertures shaped to snugly receive the first ends of the support bars; and (d) prior to welding, each of the support bars is inserted in one of the second apertures of the elongate portion.

2. A bottle rack according to claim 1, wherein the elongate portion comprises a plurality of assembling apertures suitable for a plurality of assembling fasteners to fasten the elongate portion to the panel.

3. A bottle rack according to claim 2, wherein the elongate portion has two parallel edges extending along its longitudinal direction; and the plurality of assembling apertures are positioned along the two edges so that every other one of the assembling apertures along the elongate portion is on the same side of the elongate portion.

4. A bottle rack according to claim 1, wherein the elongate portion extends parallel to an edge of the panel after the bottle rack is assembled.

5. A bottle rack comprising:

a bottle-supporting assembly having an elongate portion and a plurality of support bars connected to and cantilevered from the elongate portion, wherein the support bars are spaced longitudinally along the elongate portion; and a panel having a plurality of support bar apertures suitable for the support bars of the bottle-supporting assembly to extend through, wherein the bottle-supporting assembly is secured onto the panel with the support bars extending through the apertures of the panel, and wherein the support bars are suitable to support bottles therebetween from the panel to ends of the support bars spaced from the panel such that the longitudinal axis of each of the bottles is substantially parallel to the support bars;

wherein each of the support bars has a first end that abuts against and is fastened to the elongate portion by a support bar fastener that is inserted through the elongate portion and into the first end.

6. A bottle rack according to claim 5, wherein the elongate portion has a first side facing the panel, and the support bars are aligned in a row along the elongate portion and are substantially perpendicular to the first side of the elongate portion.

7. A bottle rack according to claim 6, wherein the elongate portion has a groove on the first side and wherein the groove snugly receives the first ends of the support bars.

8. A bottle rack according to claim 7, wherein:

(a) each of the support bars has a top side and a bottom side parallel to the top side;

(b) the groove of the elongate portion has two parallel edges extending longitudinally along the elongate portion; and (c) the groove of the elongate portion snugly receives the first ends of the support bars with the top and bottom sides fitting into the two edges of the groove.

9. A bottle rack according to claim 6, wherein the elongate portion has a plurality of bar slots on the first side of the elongate portion, spaced longitudinally along the elongate portion without extending through the elongate portion, and each of the bar slots snugly receives the first end of one of the support bars.

10. A bottle rack according to claim 5, wherein the support bar fastener comprises at least one screw.

11. A bottle rack according to claim 5, wherein the elongate portion comprises a plurality of assembling apertures suitable for a plurality of assembling fasteners to fasten the elongate portion to the panel.

12. A bottle rack according to claim 11, wherein the elongate portion has two parallel edges extending along its longitudinal direction; and the plurality of assembling apertures are positioned along the two edges so that every other one of the assembling apertures along the elongate portion is on the same side of the elongate portion.

13. A bottle rack according to claim 5, further comprising a pair of mounting brackets affixed to the panel for mounting the panel to a wall.

14. A bottle rack according to claim 13, wherein each of the mounting brackets has at least one keyhole-shaped aperture; and the panel has at least one pair of protrusions suitable to insert within the keyhole-shaped apertures thereby selectively connecting the panel to the brackets.

15. A bottle rack according to claim 13, wherein the bottle rack comprises a plurality of the panels each having at least one said bottle-supporting assembly.

16. A bottle rack according to claim 15 further comprising at least one link mechanism suitable to link two mounting brackets that mount two adjacent panels.

17. A bottle rack according to claim 16, wherein each of the two mounting brackets comprises:

a wall-abutting portion to abut the wall when the bottle rack is mounted to the wall;

a peripheral portion connected to and extending outwards from the wall-abutting portion;

a panel-abutting portion connected to and extending from the peripheral portion, to which the panel is affixed;

wherein each of the mounting brackets has a channel between the wall-abutting portion and the panel-abutting portion extending longitudinally between the ends of the mounting bracket; and wherein the link mechanism comprises a link plate suitable to insert into the channels of the mounting brackets and at least two link fasteners for securing the link plate in the channels of the mounting brackets.

18. A bottle rack according to claim 17, wherein each of the link fasteners comprises a link screw having a socket in a head thereof; the link plate comprises at least two threaded apertures suitable to receive the screws; and the link mechanism is configured in a manner that when each of the link screws is screwed in and forced against the panel-abutting portion of the mounting bracket, the link plate is pressed against the wall-abutting portion of the mounting bracket, thereby securing the link mechanism in the channel of the mounting bracket.

19. A bottle rack according to claim 15, wherein at least one of the mounting brackets has a greater length than the panels, and at least two adjacent panels are connected to the mounting bracket.

20. A bottle rack according to claim 5, wherein the elongate portion extends parallel to an edge of the panel after the bottle rack is assembled.

21. A bottle rack comprising:

a bottle-supporting assembly having an elongate portion and a plurality of support bars welded to and cantilevered from the elongate portion, wherein the support bars are spaced longitudinally along the elongate portion;

a panel having a plurality of support bar apertures suitable for the support bars of the bottle-supporting assembly to extend through, wherein the bottle-supporting assembly is secured onto the panel with the support bars extending through the apertures of the panel and wherein the support bars are suitable to support bottles therebetween from the panel to ends of the support bars spaced from the panel such that the longitudinal axis of each of the bottles is substantially parallel to the support bars; and a pair of mounting brackets affixed to the panel for mounting the panel to a wall, wherein each of the mounting brackets has at least one keyhole-shaped aperture, and the panel has at least one pair of protrusions suitable to insert within the keyhole-shaped apertures thereby selectively connecting the panel to the brackets.

22. A bottle rack according to claim 21, wherein the elongate portion comprises a plurality of assembling apertures suitable for a plurality of assembling fasteners to fasten the elongate portion to the panel.

23. A bottle rack according to claim 22, wherein the elongate portion has two parallel edges extending along its longitudinal direction; and the plurality of assembling apertures are positioned along the two edges so that every other one of the assembling apertures along the elongate portion is on the same side of the elongate portion.

24. A bottle rack according to claim 21, wherein the elongate portion extends parallel to an edge of the panel after the bottle rack is assembled.

25. A bottle rack comprising:

a bottle-supporting assembly having an elongate portion and a plurality of support bars welded to and cantilevered from the elongate portion, wherein the support bars are spaced longitudinally along the elongate portion;

a panel having a plurality of support bar apertures suitable for the support bars of the bottle-supporting assembly to extend through, wherein the bottle-supporting assembly is secured onto the panel with the support bars extending through the apertures of the panel and wherein the support bars are suitable to support bottles therebetween from the panel to ends of the support bars spaced from the panel such that the longitudinal axis of each of the bottles is substantially parallel to the support bars; and a pair of mounting brackets affixed to the panel for mounting the panel to a wall, wherein the bottle rack comprises a plurality of the panels each having at least one said bottle-supporting assembly.

26. A bottle rack according to claim 25 further comprising at least one link mechanism suitable to link two mounting brackets that mount two adjacent panels.

27. A bottle rack according to claim 26, wherein each of the two mounting brackets comprises:

a wall-abutting portion to abut the wall when the bottle rack is mounted to the wall;

a peripheral portion connected to and extending outwards from the wall-abutting portion; and a panel-abutting portion connected to and extending from the peripheral portion, to which the panel is affixed;

wherein each of the mounting brackets has a channel between the wall-abutting portion and the panel-abutting portion extending longitudinally between the ends of the mounting bracket; and wherein the link mechanism comprises a link plate suitable to insert into the channels of the mounting brackets and at least two link fasteners for securing the link plate in the channels of the mounting brackets.

28. A bottle rack according to claim 27, wherein each of the link fasteners comprises a link screw having a socket in a head thereof; the link plate comprises at least two threaded apertures suitable to receive the screws; and the link mechanism is configured in a manner that when each of the link screws is screwed in and forced against the panel-abutting portion of the mounting bracket, the link plate is pressed against the wall-abutting portion of the mounting bracket, thereby securing the link mechanism in the channel of the mounting bracket.

29. A bottle rack according to claim 25, wherein at least one of the mounting brackets has a greater length than the panels, and at least two adjacent panels are connected to the mounting bracket.

30. A bottle rack according to claim 25, wherein the elongate portion comprises a plurality of assembling apertures suitable for a plurality of assembling fasteners to fasten the elongate portion to the panel.

31. A bottle rack according to claim 30, wherein the elongate portion has two parallel edges extending along its longitudinal direction; and the plurality of assembling apertures are positioned along the two edges so that every other one of the assembling apertures along the elongate portion is on the same side of the elongate portion.

32. A bottle rack according to claim 25, wherein the elongate portion extends parallel to an edge of the panel after the bottle rack is assembled.

* * * * *